US008820003B2

(12) United States Patent
DeLorean

(10) Patent No.: US 8,820,003 B2
(45) Date of Patent: Sep. 2, 2014

(54) RETRACTABLE ATTIC CLOSET

(71) Applicant: Jack Z. DeLorean, Bloomfield Village, MI (US)

(72) Inventor: Jack Z. DeLorean, Bloomfield Village, MI (US)

(73) Assignee: DeLorean, LLC, Bloomfield, MI (US)

( * ) Notice: Subject to any disclaimer, the term of this patent is extended or adjusted under 35 U.S.C. 154(b) by 0 days.

(21) Appl. No.: 13/968,229

(22) Filed: Aug. 15, 2013

(65) Prior Publication Data

US 2014/0053472 A1 Feb. 27, 2014

Related U.S. Application Data

(60) Provisional application No. 61/692,147, filed on Aug. 22, 2012.

(51) Int. Cl.
*A47B 51/00* (2006.01)
*A47B 81/00* (2006.01)

(52) U.S. Cl.
CPC ..... *A47B 81/00* (2013.01)
USPC ..... 52/29; 52/67; 312/242; 312/247

(58) Field of Classification Search
CPC ..... A47B 51/00; F24C 15/027; E04B 9/003
USPC ..... 52/29, 67; 312/242, 245–247; 414/267, 414/281
See application file for complete search history.

(56) References Cited

U.S. PATENT DOCUMENTS

| | | | | | |
|---|---|---|---|---|---|
| 982,056 | A | * | 1/1911 | Hammell | 62/260 |
| 2,086,002 | A | * | 7/1937 | Shepard | 187/255 |
| 2,382,354 | A | * | 8/1945 | Wales | 312/247 |
| 2,499,791 | A | | 3/1950 | Spencer | |
| 2,506,086 | A | * | 5/1950 | Jess | 312/247 |
| 2,555,254 | A | * | 5/1951 | Stebbins | 312/319.7 |
| 3,415,586 | A | * | 12/1968 | Hammond | 312/312 |
| 3,467,460 | A | | 9/1969 | Acker | |
| 3,608,674 | A | * | 9/1971 | Phillips | 187/270 |
| 4,344,505 | A | | 8/1982 | Waters et al. | |
| 4,412,601 | A | | 11/1983 | Cooper | |
| 4,658,555 | A | | 4/1987 | Steiner | |
| 4,669,773 | A | * | 6/1987 | LeVee | 296/37.7 |
| 5,203,619 | A | * | 4/1993 | Welsch et al. | 312/247 |
| 5,319,903 | A | * | 6/1994 | Holland | 52/79.1 |
| 5,475,949 | A | | 12/1995 | McCoy | |

(Continued)

FOREIGN PATENT DOCUMENTS

| | | | |
|---|---|---|---|
| EP | 0794278 | A1 | 10/1997 |
| GB | 2253994 | A1 | 9/1992 |

*Primary Examiner* — Robert Canfield
(74) *Attorney, Agent, or Firm* — David Pressman

(57) ABSTRACT

A closet can fit into an attic and a cabinet (105) can be retracted out of the closet to the living space below manually, or using a return spring or electrical means. An air space (150) around the cabinet insulates it from thermal contact with the walls. A panel (110) with vent openings (155) is affixed to the bottom of the cabinet. In an alternative embodiment the cabinet is hung from a restraining member (145), or arm (1105), by which it can be raised for storage and lowered for access. When raised, the panel is in contact with the ceiling (110) between the attic and air from the living space mixes into the air space by convection. A fan (160) can urge circulation between the air space and the living space, reducing of temperature extremes in the air space and hence the cabinet.

21 Claims, 23 Drawing Sheets

(56) References Cited

U.S. PATENT DOCUMENTS

| | | | | |
|---|---|---|---|---|
| 5,535,852 | A * | 7/1996 | Bishop et al. | 187/336 |
| 5,667,035 | A | 9/1997 | Hughes | |
| 5,688,169 | A * | 11/1997 | Duong et al. | 454/184 |
| 6,095,344 | A | 8/2000 | White | |
| 6,223,490 | B1 | 5/2001 | Wessley et al. | |
| 6,250,728 | B1 | 6/2001 | Thorp | |
| 6,336,692 | B1 * | 1/2002 | Snyder | 312/312 |
| 6,547,183 | B2 | 4/2003 | Farnsworth | |
| D480,892 | S | 10/2003 | White | |
| 6,877,551 | B2 * | 4/2005 | Stoller | 165/47 |
| 7,246,865 | B1 | 7/2007 | Merrell | |
| 7,690,165 | B2 | 4/2010 | Taylor | |
| 7,841,134 | B2 | 11/2010 | Verry | |
| 7,926,229 | B2 | 4/2011 | Melesky | |
| 8,072,752 | B2 * | 12/2011 | Wantschik | 361/695 |
| 8,136,897 | B2 | 3/2012 | Mascari | |
| 8,157,108 | B1 | 4/2012 | Waldrop | |
| 8,162,159 | B2 | 4/2012 | Carter | |
| 8,292,031 | B2 | 10/2012 | Penn et al. | |
| 8,418,814 | B1 | 4/2013 | Byers | |
| 2002/0117077 | A1 | 8/2002 | Johannes | |
| 2005/0098387 | A1 * | 5/2005 | Penn et al. | 187/262 |
| 2006/0066188 | A1 | 3/2006 | Crawford | |
| 2008/0289264 | A1 | 11/2008 | Bowman | |
| 2008/0296089 | A1 | 12/2008 | Penn et al. | |
| 2010/0099346 | A1 | 4/2010 | Browne | |
| 2012/0186179 | A1 | 7/2012 | Melesky | |
| 2013/0180168 | A1 * | 7/2013 | Elliott | 47/17 |

* cited by examiner

RETRACTABLE ATTIC CLOSET

CROSS-REFERENCE TO RELATED APPLICATION

This application claims priority of Provisional Patent Application Ser. No. 61/692,147, filed 2012 Aug. 22.

BACKGROUND

Prior Art—Attic Closets

Home attic areas provide cost-free and nearby storage space. However access is generally difficult, even with attic ladders. Such ladders are often quite narrow and difficult to navigate, especially while carrying items to and from storage. Recent widespread use of obstructive trusses in residential construction hinders movement within an attic and limits weight loads, further restricting storage potential. Temperatures in some attics approach 65° C. (150° F.), which can be damaging to clothing, shoes, books, photographs, and other stored goods. The need to mitigate the destructive effects of heat in an attic is well known.

To take advantage of attic space, homeowners have used closets in their attics to facilitate orderly storage. The following is a list and a discussion of some possibly relevant prior art that shows a variety of attic closets.

U.S. Utility Patents

| Patent or Pub. Nr. | Kind Code | Issue or Pub. Date | Patentee or Applicant |
|---|---|---|---|
| | | U.S. Utility Patents | |
| 2,499,791 | B1 | Mar. 7, 1950 | Spencer |
| 3,467,460 | B1 | Sept. 16, 1969 | Acker |
| 4,344,505 | B1 | Aug. 17, 1982 | Waters et al. |
| 4,412,601 | B1 | Nov. 1, 1983 | Cooper |
| 4,658,555 | B1 | Apr. 21, 1987 | Steiner |
| 5,475,949 | B1 | Dec. 19, 1995 | McCoy |
| 5,667,035 | B1 | Sept. 16, 1997 | Hughes |
| 6,223,490 | B1 | May 1, 2001 | Wessley et al. |
| 6,250,728 | B1 | Jun. 26, 2001 | Thorp |
| 6,547,183 | B2 | Apr. 15, 2003 | Farnsworth |
| 7,246,865 | B1 | Jul. 24, 2007 | Merrell |
| 7,690,165 | B2 | Apr. 6, 2010 | Taylor |
| 7,841,134 | B2 | Apr. 30, 2010 | Verry |
| 7,926,229 | B2 | Apr. 19, 2011 | Melesky |
| 8,136,897 | B2 | Mar. 20, 2012 | Mascari |
| 8,157,108 | B1 | Apr. 17, 2012 | Waldrop |
| 8,162,159 | B2 | Apr. 24, 2012 | Carter |
| 8,292,031 | B2 | Oct. 23, 2012 | Penn et al. |
| 8,418,814 | B1 | Apr. 16, 2013 | Byers |
| | | U.S. Design Patents | |
| D480,892 | S | Oct. 21, 2003 | White |
| | | U.S. Published Patent Applications | |
| 2002/0117077 | A1 | Aug. 29, 2002 | Johannes |
| 2006/0066188 | A1 | Mar. 30, 2006 | Crawford |
| 2008/0289264 | A1 | Nov. 27, 2008 | Bowman |
| 2008/0296089 | A1 | Dec. 4, 2008 | Penn et al. |
| 2012/0186179 | A1 | Jul. 26, 2012 | Melesky |

Foreign Patent Documents

| Foreign Doc. Nr. | Country Code | Kind Code | Publication Date | Patentee/ Applicant |
|---|---|---|---|---|
| 2253994 | GB | A1 | Sept. 30, 1992 | Acton |

U.S. Design Patents

| | | | |
|---|---|---|---|
| D480,892 | S | Oct. 21, 2003 | White |

U.S. Published Patent Applications

| | | | |
|---|---|---|---|
| 2002/0117077 | A1 | Aug. 29, 2002 | Johannes |
| 2006/0066188 | A1 | Mar. 30, 2006 | Crawford |
| 2008/0289264 | A1 | Nov. 27, 2008 | Bowman |
| 2008/0296089 | A1 | Dec. 4, 2008 | Penn et al. |
| 2012/0186179 | A1 | Jul. 26, 2012 | Melesky |

Foreign Patent Documents

| Foreign Doc. Nr. | Country Code | Kind Code | Publication Date | Patentee/ Applicant |
|---|---|---|---|---|
| 2253994 | GB | A1 | Sept. 30, 1992 | Acton |

Spencer shows a "disappearing closet" that retracts into the attic but there is no enclosure in the attic. The closet can be moved by a motor system through a framed hole in the ceiling into the attic. The motor system is secured at the upper ends of studs that run between the attic floor and the roof.

Acker also shows an enclosure that is mounted in the floor above. A closet can be moved by a motor system through a hole in the ceiling into an enclosure. The retractable closets of Spencer and Acker are subject to the aforementioned attic heat and the harm that such heat can wreak on the closer's contents.

Waters et al. shows a moveable insulating block above an attic opening that is similar in function to Melesky and Verry, below.

Cooper discloses an "elevator lift system" that can retract a platform into an enclosure in the floor above. While Cooper shows an enclosure in the floor above, it would be difficult to load storable items into this closet because one must use an awkward elevator platform.

Steiner shows an insulating cover for an attic opening that is similar to Melesky and Verry, below.

McCoy also shows an enclosure that is mounted in the floor above. A closet can be moved by a motor system through a hole in the ceiling into the enclosure.

Hughes discloses another motorized lift system similar to that of Penn, below. Penn and Hughes have closets that are subject to the aforementioned attic heat and the harm that such heat can wreak on the closer's contents.

Wessley et al. shows an insulating cover for an attic entrance, called a scuttle hole.

Thorp shows a closet which is retractable into an enclosure in the ceiling and is suspended by pulleys.

Farnsworth shows a vertically retractable closet for an airplane so that when raised into an enclosure above, the space can be used to allow a seat to recline.

Merrell '865 and Merrell '580 show a shelf unit that pivots into an enclosure in the floor above. McCoy, Thorp, Farnsworth, White, Johannes, and Merrell again have closet that are subject to the aforementioned attic heat and the harm that such heat can wreak on the closer's contents.

Taylor shows an insulating cover for an attic opening that is similar to Melesky and Verry.

Verry shows an insulating cover for pull-down stairs. It is similar to Melesky in that the cover in the attic is more insulating that the bottom cover.

Melesky (patent and published patent application) shows in FIG. 1 a top 28 and sides 24 of a housing in the attic which is more insulating than a bottom or ceiling cover 14.

Mascari discloses a hinged, telescoping storage container for attachment to a ceiling attic.

Waldrop discloses a drop-down shelf storage system.

Carter discloses a modular storage unit for a garage platform.

Penn et al. (patent and published patent application) shows a platform lift system that raises a platform for holding objects into the attic or floor above.

Byers discloses primarily a lift mechanism for storing objects in an attic storage. The objects are lifted up through a portal.

White shows a set of shelves that slides up on tracks into an enclosure (or vice versa).

Johannes shows a container which can be raised toward the ceiling of a garage by a motorized system.

Crawford shows an enclosure that is mounted in the floor above. A rack of shelves can be moved by a motor system through a hole in the ceiling into the enclosure in the floor above. The enclosure may be insulated. However such insulation will not eliminate all of the effects of attic heat, especially when the enclosure is exposed to the heat for a long period of time.

Bowman also shows an enclosure that is mounted in the floor above. A closet can be moved by a motor system through a hole in the ceiling into the enclosure.

Acton discloses a wardrobe 2 that retracts into attic enclosure 1.

While the above-described closets are each useful for their intended purposes, each has one or more disadvantages as noted.

SUMMARY

An attic closet overcomes one or more of the deficiencies of prior-art attic closets. In particular, an insulated closet is installed in an attic or other overhead space. A cabinet for storing items is suspended from the closet by one or more cables. A motive source raises the cabinet from a room below up into the closet for stowage and lowers the cabinet for access to its contents. A panel is secured to the bottom of the cabinet. When the cabinet is stowed in the closet the panel is flush against the ceiling of the room or living space below. When stowed, the cabinet is thermally insulated from the inner closet walls by an air space. One or more vent openings in the panel permit circulation and exchange of the air in the living space with that in the air space between the cabinet and the inner closet walls. The mixing of lower temperature air from the living space and higher temperature air in the overhead attic air space results in a generally lower temperature in the closet and the cabinet. Similarly, when the attic is cold, warmer air from the living space mixes with the air in the air space, resulting in a generally higher temperature in the closet and the cabinet. Thus temperature swings within the closet are minimized and the contents of the closet are preserved. Different aspects of various embodiments include an electrical fan for additional air flow, spring-loaded vent opening doors normally restrained with fusible links to prevent fire in the living space from entering the attic, insulated outer doors on the cabinet, a cabinet for storage bins, an empty cabinet for transporting objects between an attic and the living space, and an alternative manually operated support for the cabinet.

DRAWING FIGURES

DRAWING REFERENCE NUMERALS

| | | | |
|---|---|---|---|
| 100 | Closet | 104 | Hinge |
| 105 | Cabinet | 106 | Door |
| 107 | Drawer | 108 | Fastener |
| 110 | Panel | 115 | Joist |
| 120 | Framing member | 125 | Bracket |
| 130 | Fastener | 131 | Fastener |
| 135 | Ceiling | 140 | Connecting member |
| 145 | Restraining member | 147 | Hole |
| 150 | Air space | 155 | Vent opening |
| 160 | Fan | 161 | Flap |
| 165 | Conduit | 200 | Sliding member |
| 205 | Fastener | 210 | Fastener |
| 215 | Skid | 220 | Caster |
| 225 | Stop | 600 | Baffle |
| 400 | Door | 605 | Membrane |
| 610 | Fastener | 800 | Baffle |
| 805 | Vent | 810 | Vent |
| 815 | Duct | 816 | Holes |
| 900 | Door | 905 | Hinge |
| 910 | Spring | 915 | Restraint |
| 920 | Link | 925 | Fastener |
| 930 | Baffle | 935 | Baffle plate |
| 940 | Spring | 945 | Bracket |
| 950 | Foot | 955 | Bulged portion |
| 1000 | Motor | 1005 | Bracket |
| 1010 | Brace | 1015 | Brace |
| 1025 | Shaft | 1030 | Cable drum |
| 1035 | Conduit | 1040 | Speed reducer |

-continued

| | | | |
|---|---|---|---|
| 1050 | Pulley | 1055 | Pulley |
| 1060 | Cable | 1065 | Bracket |
| 1070 | Support | 1072 | Support |
| 1075 | Spring | 1100 | Cabinet |
| 1105 | Arm | 1110 | Pivot |
| 1115 | Counterweight | 1120 | Spring |
| 1125 | Cord | 1200 | Panel |
| 1202 | Opening | 1205 | Finger |
| 1210 | Clasp | 1215 | Handle |
| 1300 | Bin | 1305 | Partition |
| 1310 | Bracket | 1315 | Drawer pull |

DESCRIPTION

First Embodiment—FIGS. 1A-3

Figure 1A:
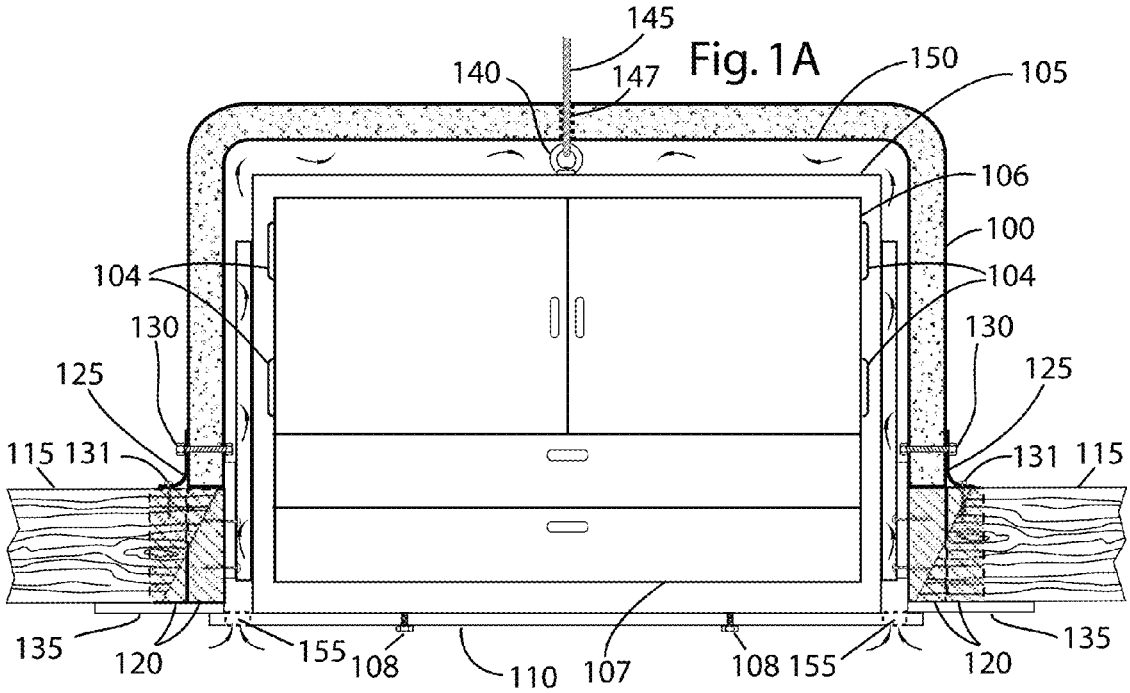
FIG. 1A shows a cut-away view of an embodiment of a closet with a cabinet in the stowed position.
Figure 1B:
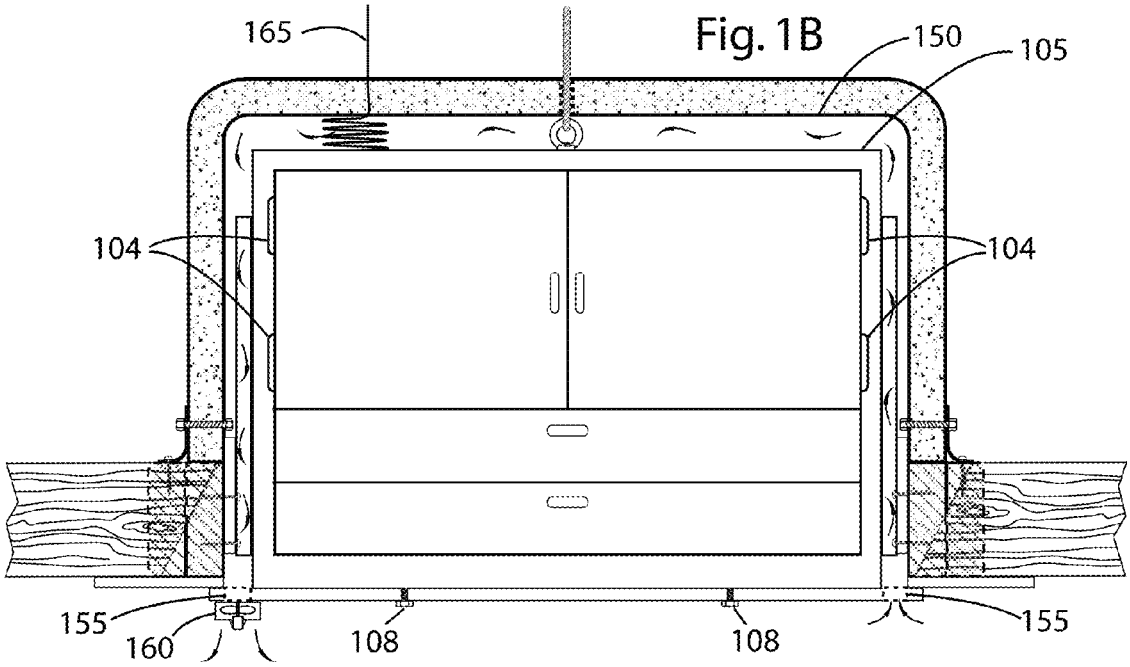
FIG. 1B shows an alternative aspect of the embodiment of FIG. 1 with an optional fan.

FIGS. 1A and 1B show front, cut-away views of an attic closet system that comprises an outer closet or enclosure 100, a cabinet 105 with one or more doors 106 swingably supported on hinges 104, drawers 107, and a ceiling panel 110 that includes a plurality of vent openings 155. Closet or enclosure 100 is mounted in an attic and is secured to ceiling joists or truss bottom chords 115 and framing members 120 by angle brackets 125 and fasteners 130 and 131. Closet or enclosure 100 is a box-shaped enclosure that has five sides and is open on its bottom side. Joists 115 and framing members 120 are covered from below by a ceiling 135 which has an opening congruent with the open bottom side of closet or enclosure 100. A connecting member 140, such as an eye bolt, is secured to the top of cabinet 105. The lower end of a vertical traction member 145, such as a rope, cable, or rod, is attached to connecting member 140. Its upper end (FIG. 10B) is attached to a traction control member 1030, such as a cable drum. Panel 110 is secured to the bottom of cabinet 105 by one or more fasteners 108. Fasteners 108 can be permanent or semi-permanent members, such as rivets or screws, or removable fasteners, such as magnets for easy cleaning of the top surface of panel 110.

Figure 1C:
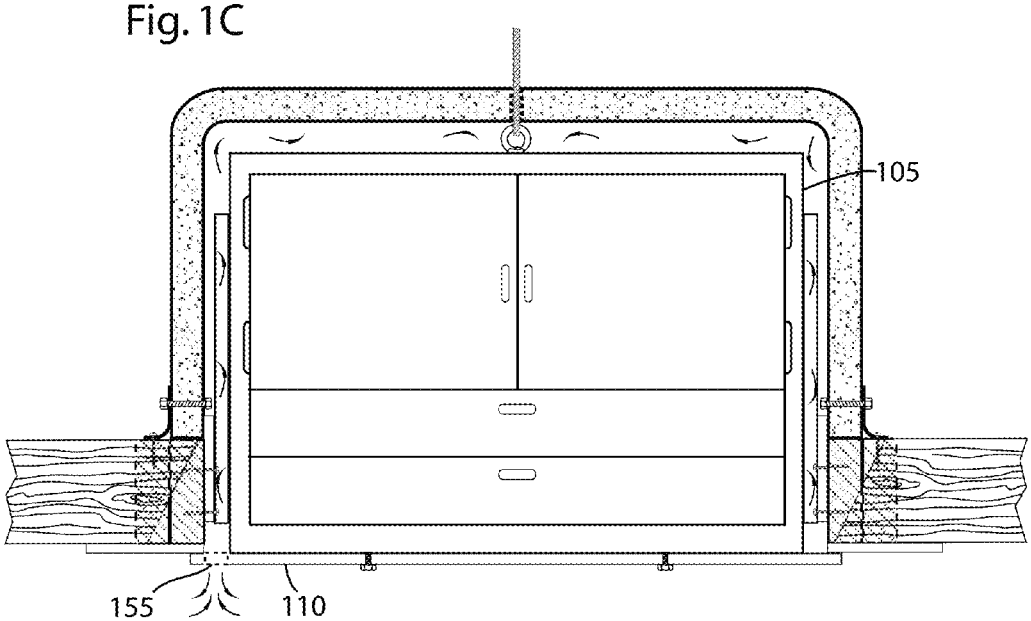
FIG. 1C shows an alternative aspect of the embodiment of FIG. 1 with a single vent opening.

FIG. 1C is a front, cut-away view of an attic closet system similar to that of FIGS. 1A and 1B, except this aspect has only a single vent opening 155 in panel 110, along one side of cabinet 105. In this case, when cabinet 105 is raised to its uppermost position, air from beneath panel 110 mixes with air above panel 110 by convective flow. This aspect is useful when temperature differences below and above panel 110 are not extreme, i.e., on the order of 10° C.

As shown, cabinet 105 is stowed within enclosure 100 but can be moved down and out of the enclosure. In this position, the upper surface of panel 110 is urged against and slightly overlaps the surface of ceiling 135. When stowed, cabinet 105 is spaced from the interior walls and top of closet or enclosure 100 by an air space 150 which surrounds all of the side walls and top of the cabinet 105, between the outsides of these side walls and the top and the inner sides of the walls and top of the closet or enclosure 100. As shown in FIG. 2D, this embodiment has a vent opening around the full perimeter of the cabinet bottom.

Figure 2A:
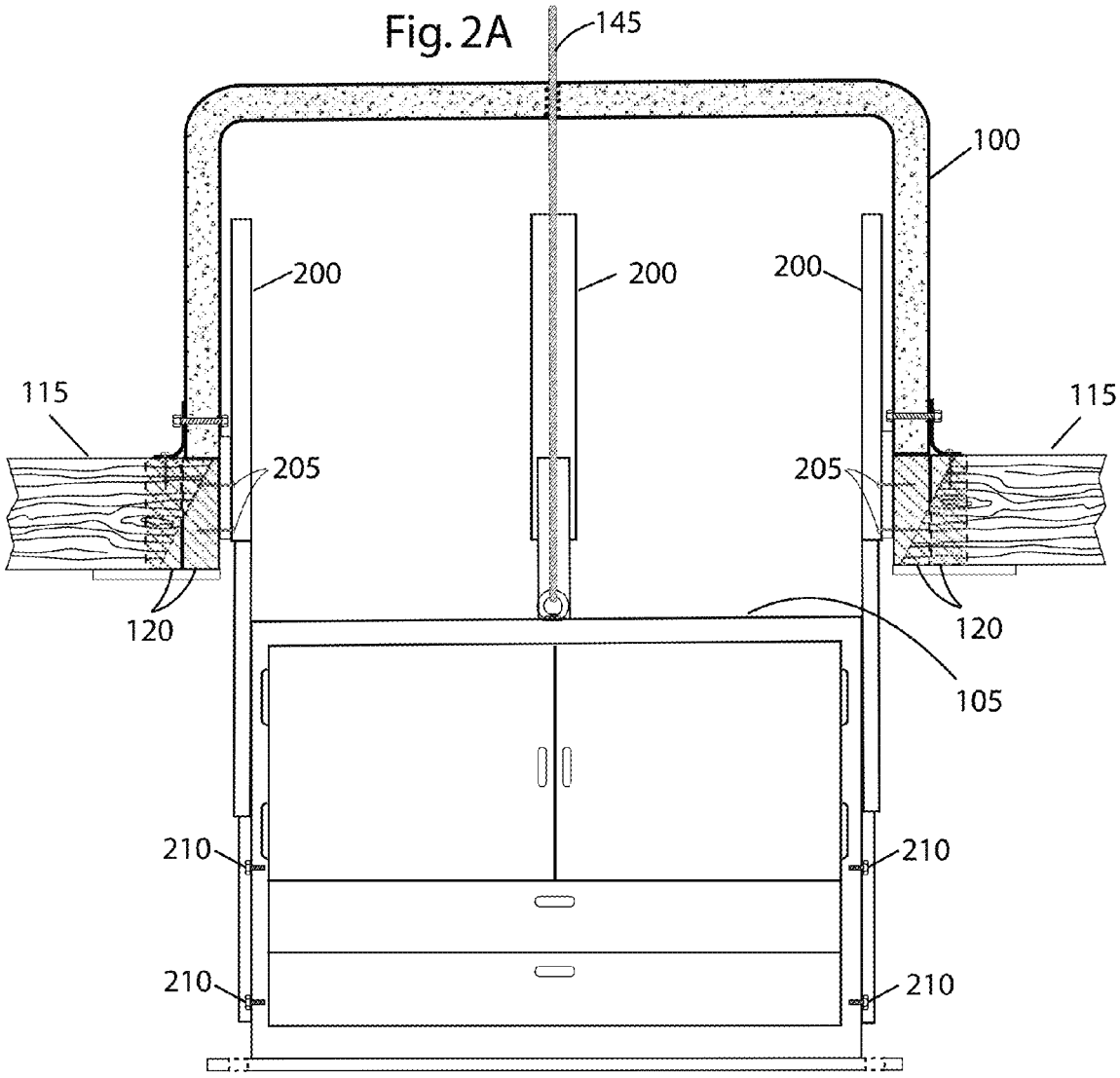
FIG. 2A shows the embodiment of FIG. 1 with the cabinet in a lowered position.

FIG. 2A shows cabinet 105 lowered from enclosure 100 into the room below the attic in which enclosure 100 is mounted. Vertical traction member 145 has been extended down from above, i.e., unwound from cable drum 1030, so that a user is able to access the contents of cabinet 105. A plurality of telescoping vertical guide slides or sliding guide members 200 are secured to joists 115 and framing members 120 by fasteners 205. Cabinet 105 is secured to slides 200 by a plurality of fasteners 210 and moves smoothly up and down when urged by restraining member 145, with its path guided by sliding members 200.

Figure 2B:
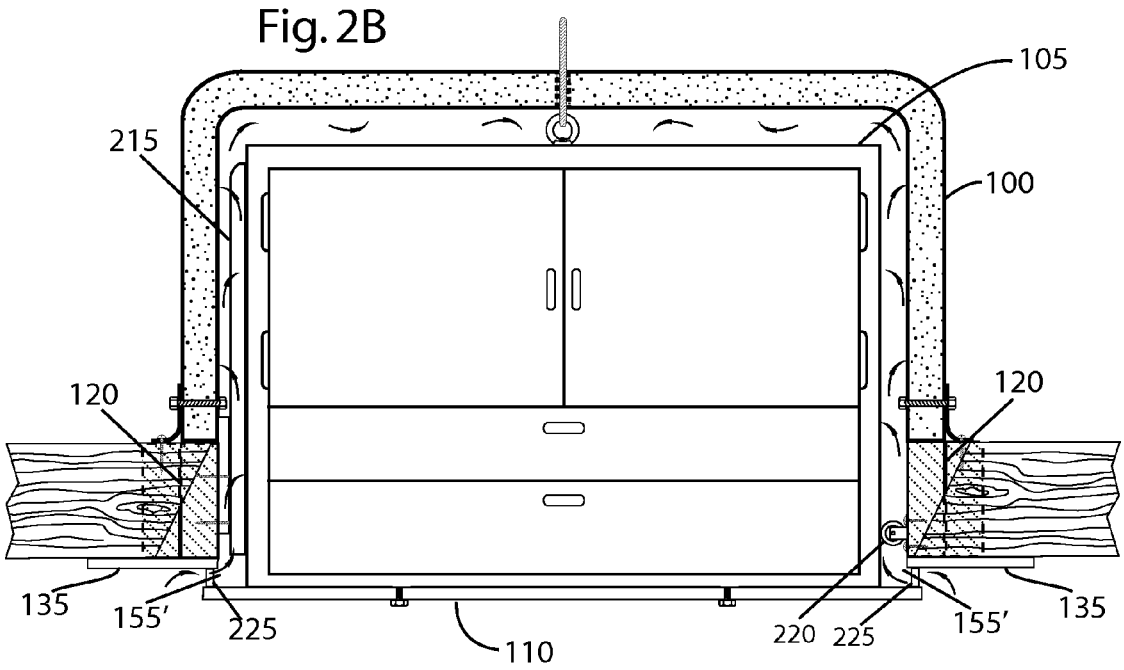
FIGS. 2B and 2C show alternative aspects of the embodiment of FIG. 1.
Figure 2C:
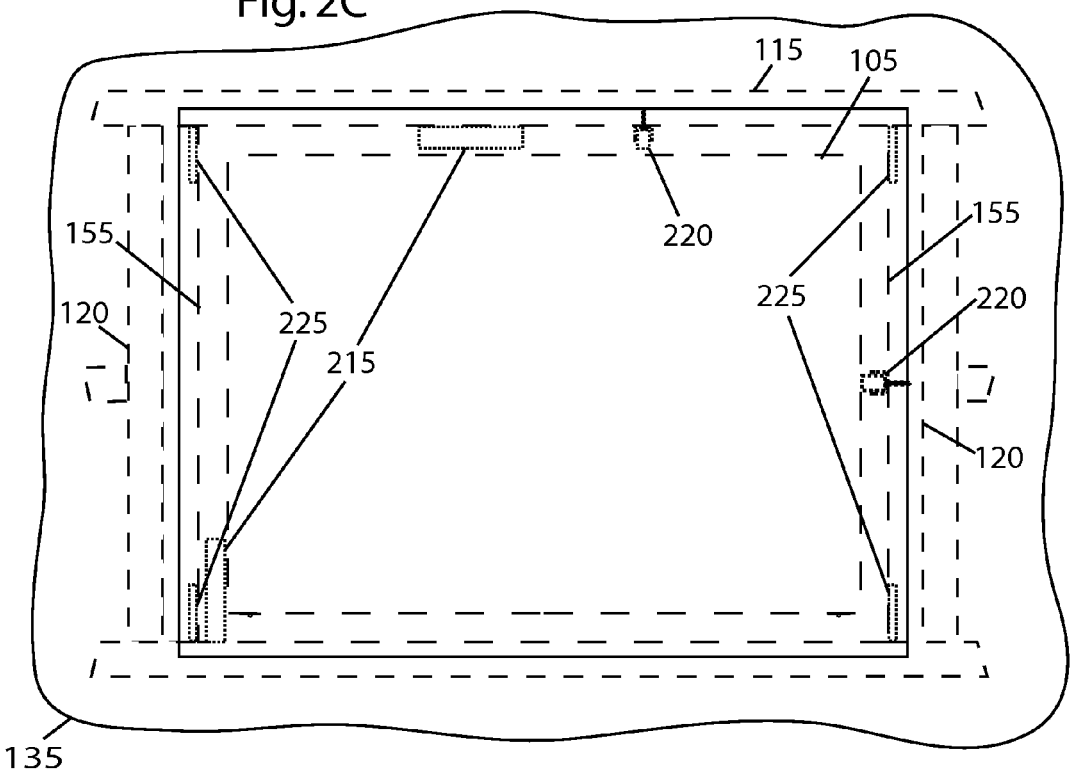
Figure 2D:
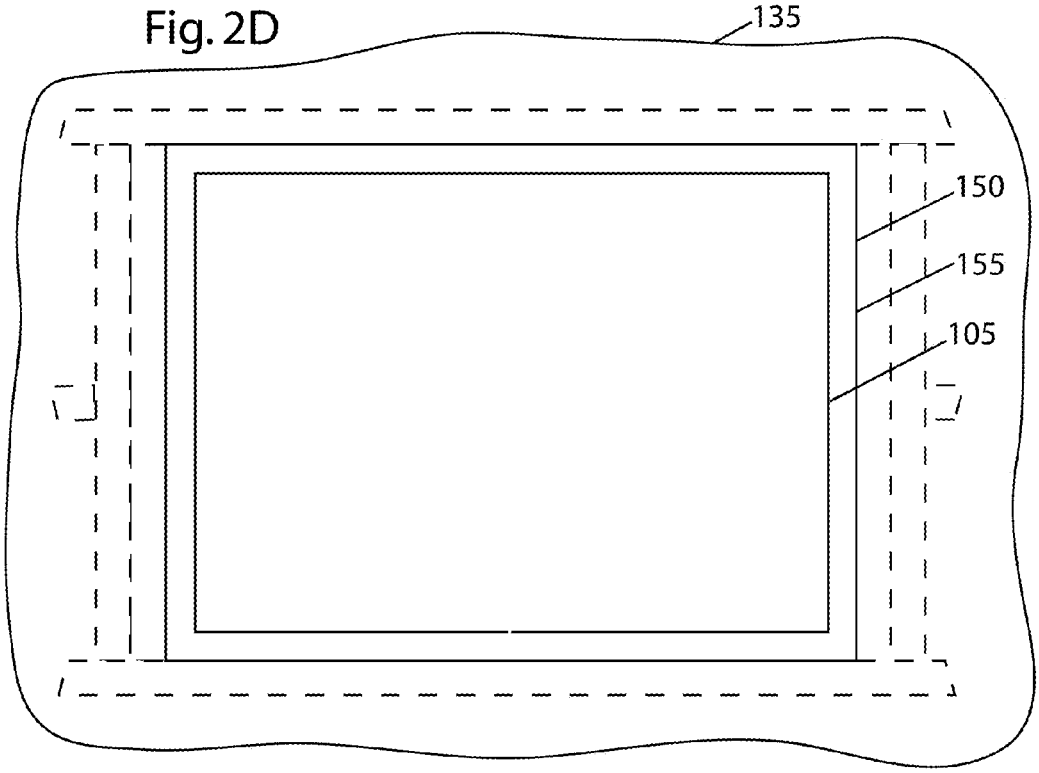
FIGS. 2D and 2E show a bottom and side views respectively of another embodiment not utilizing sliding members, stops or a bottom panel and having a vent opening around the full perimeter of the cabinet bottom.

FIGS. 2B and 2C show two alternative aspects of the present embodiment.

In a first aspect (FIG. 2B), sliding members 200 are replaced by one or more skids 215 and casters 220 that guide cabinet 105 as it moves up and down into closet 100. Skids 215 are shown secured to cabinet 105, although they can be secured to joist 115 and framing member 120 instead. Similarly, casters 220 are shown secured to joist 115 and framing member 120, although they can be secured to cabinet 105 instead.

In a second aspect (FIG. 2C), vent opening 155 is formed by a plurality of stops 225 that are secured by glue or fasteners (not shown) either to ceiling 135 or to panel 110 and create vent 155 155' by preventing panel 110 from closing against ceiling 135.

Elevation control of cabinet 105 can also be accomplished with an electrical contact or pressure switch or the like (not shown), mounted, for example, on the top of the cabinet bottom panel and the ceiling area where contact is made when the cabinet is in the stowed position. A control switch can also be located on the exterior cabinet surface positioned to engage when contact is made with a joist or structural member.

Figure 3:
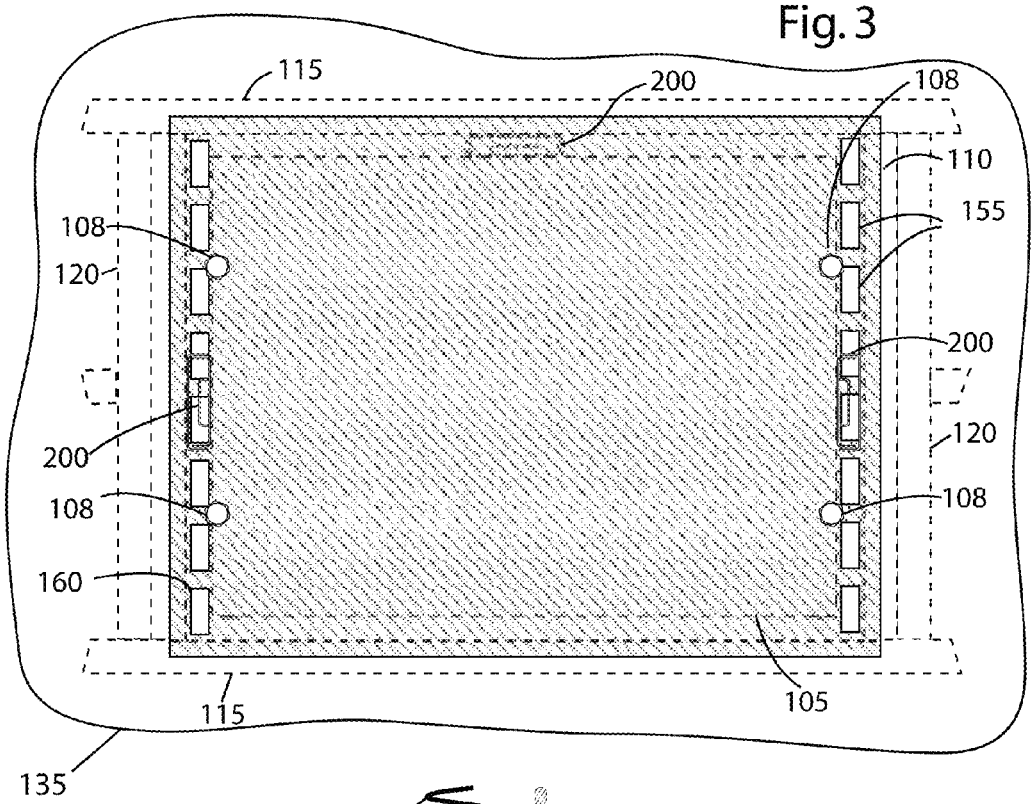
FIG. 3 shows a bottom view of one aspect of a vented panel mounted beneath a closet.
Figure 5:
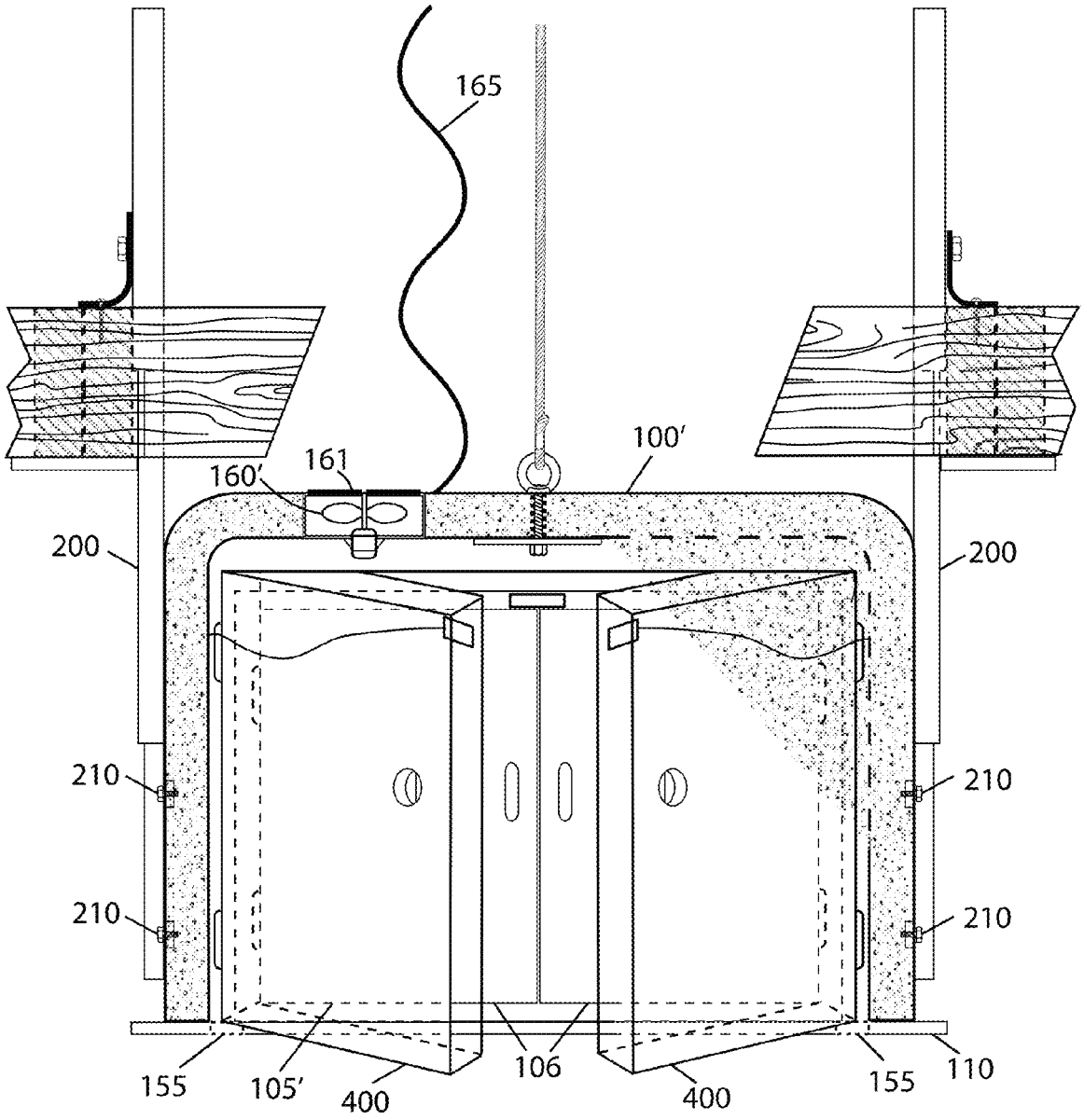

FIG. 3 shows panel 110 from below. Joists 115 and framing members 120 are hidden by ceiling 135. Panel 110 is secured to cabinet 105 by fasteners 108. Cabinet 105 is secured to vertical sliding members 200 by fasteners 210 (FIG. 5). An optional fan 160 (described below) conducts air through one or more of vents 155.

Closet 100 is made with a thermally insulating material such as fiberglass, calcium silicate (sold under the mark Mightylite by Refractory Specialties, Inc., of Sebring, Ohio), fireproof EPE (expanded polyethylene foam) sheet with aluminum film siding, and magnesium oxide cementitious foam (sold under the mark Air Krete by Air Krete, Inc., of Weedsport, N.Y.), polystyrene, or other insulative material. Closet 100 optionally has exterior metal, fiberglass or plastic composite walls for structural strength, if required to support a particular insulating material. Closet 100 can be made of any other suitable materials, including wood and all-metal construction, preferably two-walled construction, with a middle layer of insulation. Cabinet 105 is made of wood, metal, fiberglass, plastic, composite or other material and is of simple construction.

Closet 100 in FIG. 1A has exterior dimensions of 1.14 m in length, 0.85 m in width, and 0.77 m in gross height, measured from the bottom surface of ceiling 135, with the height reduced by the height of the joists 115 or truss bottom chords, not shown, and the thickness of ceiling 135. In this case the reduction is 17.8 cm, indicating a net closet height of about 0.59 m measured from the top of the joists and structural members to which it is mounted.

Cabinet 105 in FIG. 1A has an exterior length of 0.95 m, a width of 0.69 m, and a height of 0.66 m. The widths of closet 100 and cabinet 105 will generally be suited to the spacings of the ceiling joists or truss bottom chords in existing or new constructions. These are typically on 0.41 m and 0.61 m centers, respectively. Ceiling joists 115 are typically cut and cross supported with structural members or headers 120 to create a wider ceiling opening. Air space 150 between the sides of cabinet 105 and closet 100 is 4.32 cm and the air space above the cabinet is 5.33 cm. The panel is 1.08 m in length, 0.82 m in width, and 1.78 cm in thickness. Any or all of these exemplary dimensions can be modified or adapted to suit the user's requirements and the structural specifications of the building into which the unit is to be installed. With adequate roof clearance, closet 100 and cabinet 195 can be more than doubled in height to accommodate storage of longer hanging garments or other large items.

OPERATION

First Embodiment—FIGS. 1A and 1B

Passive Circulation of Air

When cabinet 105 is stowed, as shown in FIGS. 1A and 1B, vent openings 155 in panel 110 permit air to circulate and mix into air space 150 by convection between the volume or room beneath ceiling 135 and air space 150. The result of this mixing is a reduction of the difference in temperature between cabinet 105 and the living space below 100. I.e., in winter, warm air from the room below ceiling 135 enters air space 150, increasing the temperature of cabinet 105. In summer, cooler air from the room below ceiling 135 enters air space 150 and decreases the temperature of cabinet 105. Thus cabinet 105 and its contents are protected from temperature swings that occur in the attic space outside closet 100. Panel 110 completes the ceiling and covers the ceiling opening through which the closet is moved. It can be finished to match the ceiling.

Active Circulation of Air

FIG. 1B shows an alternative aspect of the embodiment in FIG. 1A. In this aspect, a fan 160 urges air to pass through one or more of vent openings 155, thereby increasing the flow of air between the room below ceiling 135 and airspace 150. Fan 160 can urge air out of or into vent openings 155. An activatable source of energy (not shown) is connected to fan 160 via a flexible conduit or cable 165. Conduit 165 rests on the top of cabinet 105 while cabinet 105 is stowed and snakes down (not shown) inside or outside of cabinet 105 to fan 160. Conduit 165 can be self-coiling. A switch for energizing fan 160 can be mounted in the room below and wired to energize line 165, or it can be a remote rf-transmitting switch that controls an rf-controllable receiving switch in line 165. Fan 160 can also be thermostatically operated so as to be energized at predetermined high and/or low temperatures.

DESCRIPTION AND OPERATION

Figure 2E:
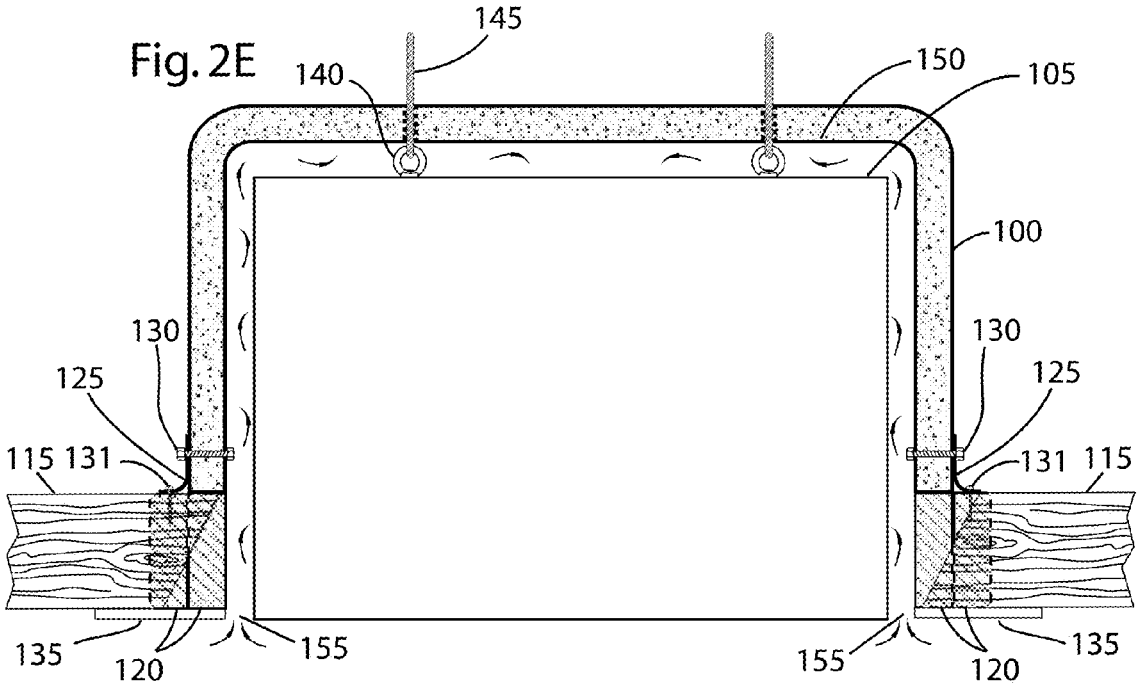

First Alternative Embodiment—FIGS. 2D and 2E

FIGS. 2D and 2E are bottom and front views that show another embodiment without sliding members 200, skids 215, casters 220, stops 225, or bottom panel 110. Cabinet 105 is manually guided to remain within air space 150 as it moves up and down past ceiling 135. As shown, air space 150 extends around all of the side walls of cabinet 105. This embodiment has a vent opening around the full perimeter of the cabinet bottom.

DESCRIPTION AND OPERATION

Figure 4:
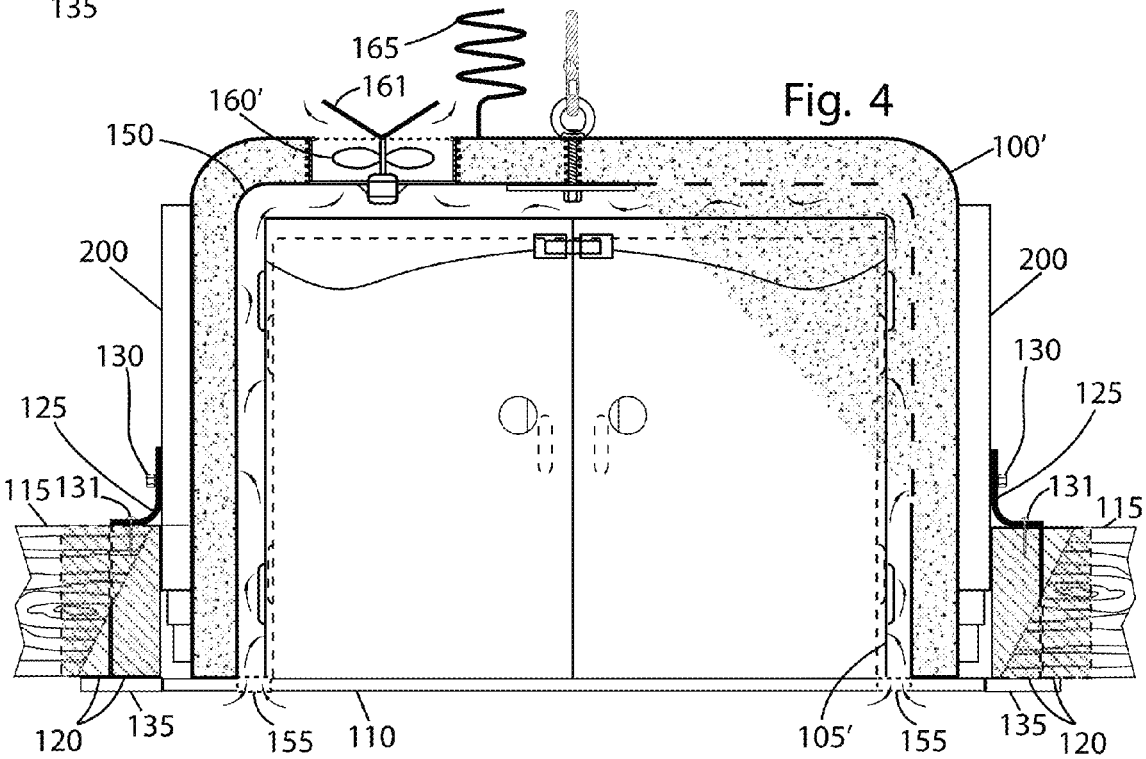
FIGS. 4 and 5 show one aspect of an alternative embodiment in which an inner cabinet is enclosed in an openable insulated closet which together can be raised for stowing (FIG. 4) and lowered for access (FIG. 5).

Second Alternative Embodiment—FIGS. 4 through 6

FIGS. 4 and 5 show one aspect of an alternative embodiment in which closet 100', containing a cabinet 105', is lowered for access to cabinet 105'. FIG. 4 shows closet 100' in its stowed position and FIG. 5 shows closet 100' in its lowered position for access to cabinet 105'. Closet 100' is secured to a plurality of vertical sliding members 200 by a plurality of fasteners 210 (FIG. 5). Sliding members 200, in turn, are secured to brackets 125 by a plurality of fasteners 130. Brackets 125 are secured to joists 115 and framing members 120 by a plurality of fasteners 131, as with the first embodiment.

Closet 100' (FIG. 5) includes a pair of hinged doors 400 that are closed when closet 100' is stowed, but can be opened when closet 100' is in its lowered position. Doors 400 are made of the same insulative material as the rest of closet 100'. When closet doors 400 and cabinet doors 106 are open, a user (not shown) has access to cabinet 105' and its contents.

FIGS. 4 and 5 show an optional fan 160' that is located atop closet 100'. When energized via conduit 165, fan 160' is arranged to urge air out of the top of closet 100', thereby drawing air into vent openings 155 in panel 110 and through air space 150. One or more flaps 161 are urged upward by air flow when fan 160' is energized (FIG. 4). When fan 160' is not energized (FIG. 5), flaps 161 are urged downward by gravity, stopping the flow of air through air space 150.

In similar fashion to the embodiment shown in FIGS. 2D and 2E, closet 100' can also operate without sliding members 200 and is manually guided into attic space as it moves up and down past ceiling 135.

Figure 6A:
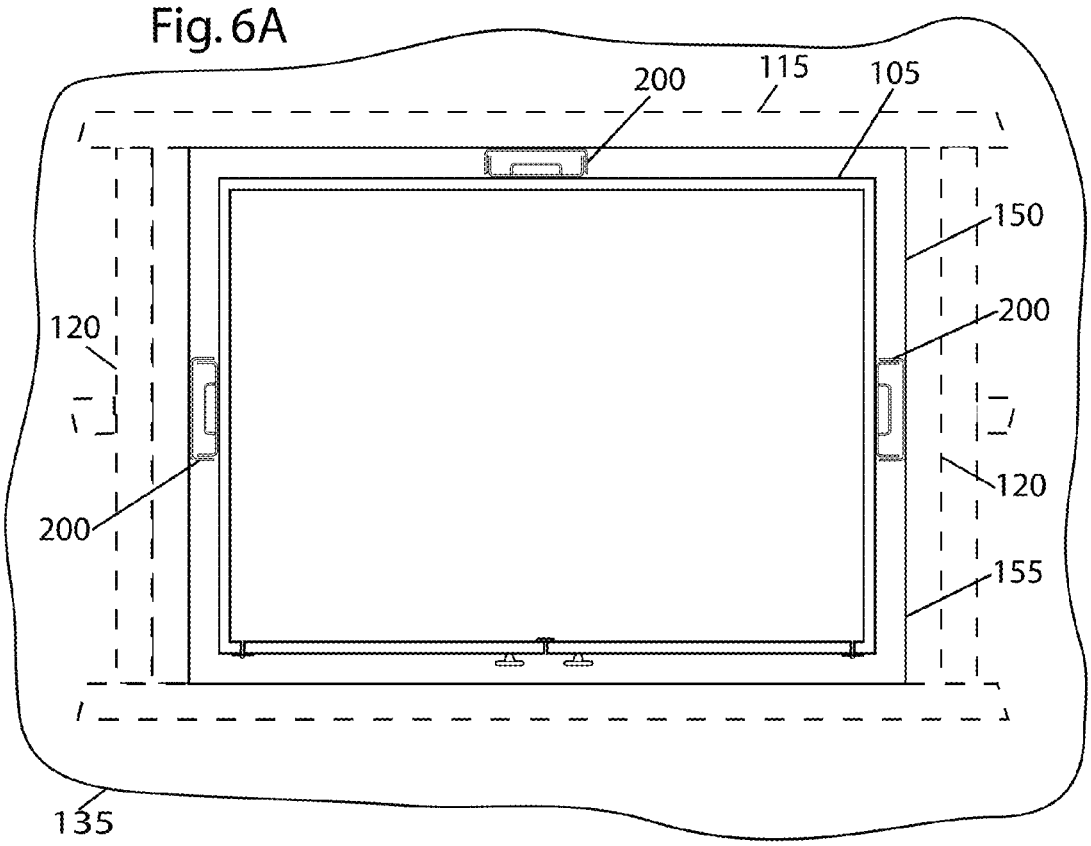
FIG. 6A is a bottom view of another aspect of the first embodiment with the vented panel of FIGS. 1-5 removed, showing construction framing and telescoping slide mounts for guiding a closet or a cabinet as it is raised and lowered.

FIG. 6A shows a bottom view of another embodiment without the use of any ceiling panel 110. Sliding members 200 are shown attached to joist 115 and framing members 120. Air space 150 surrounds cabinet 105. The embodiment shown in FIG. 6A can also operate without sliding members 200 and is manually guided into attic space as it moves up and down past ceiling 135.

Figure 6B:
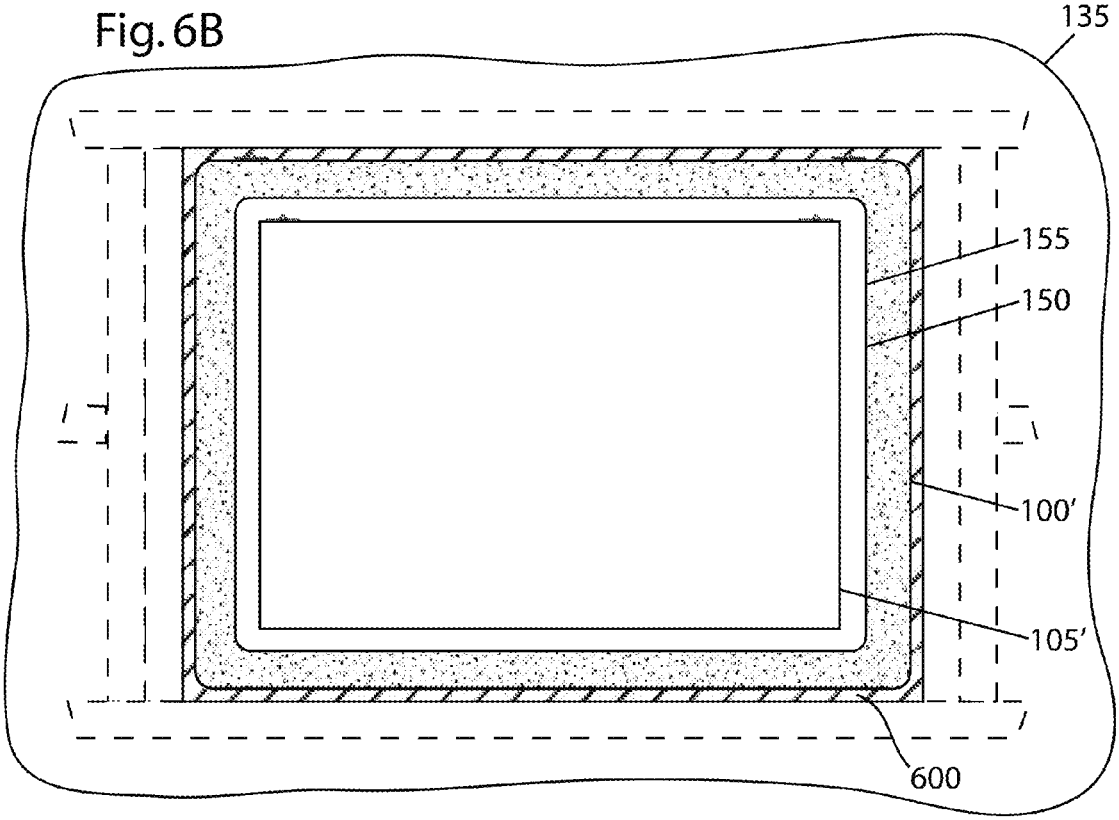
FIGS. 6B and 6C are bottom and side views, respectively, of another embodiment not utilizing sliding members, stops or a bottom panel, wherein an air-blocking barrier is secured around the outer, bottom periphery of the closet which lowers simultaneously with the cabinet.
Figure 6C:
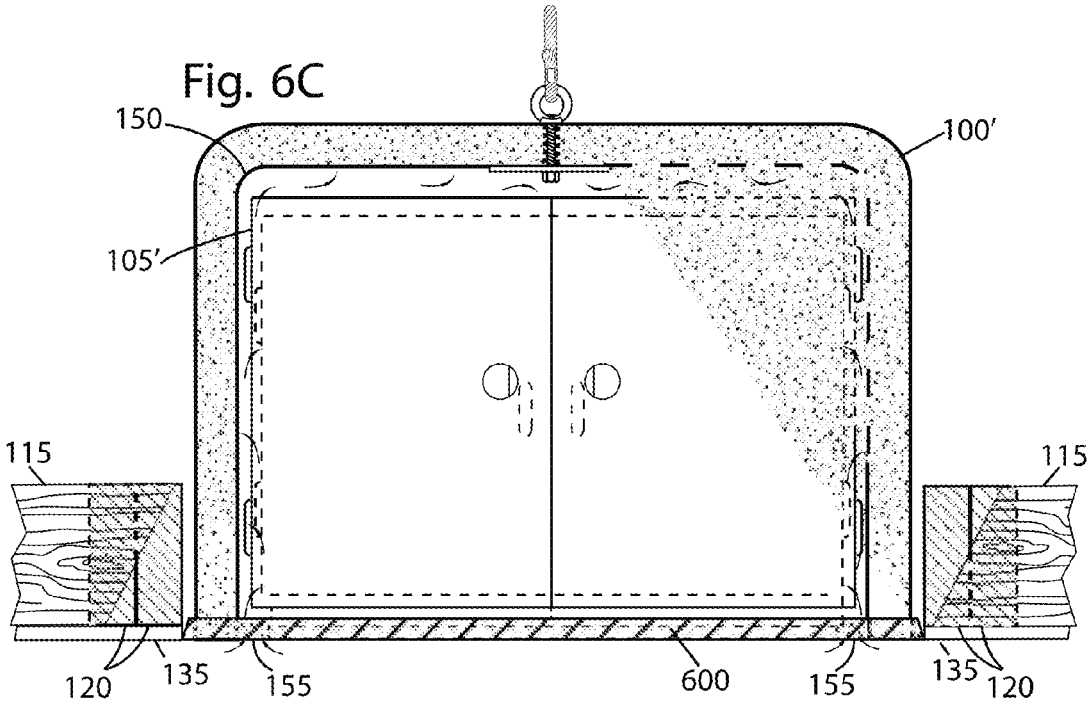

FIGS. 6B and 6C show bottom and side views, respectively, of another embodiment not utilizing sliding members, stops or a bottom panel. Air space 150 between cabinet 105' and the inner wall of closet 100' is open to the living space below. A baffle 600 surrounds the lower periphery of closet 100'. When closet 100' is in its upmost position, baffle 600 fills the gap between closet 100' and ceiling 135, thus blocking air flow between the regions below and above ceiling 135. Air can still be allowed to circulate between the outer walls of cabinet 105' and the room below ceiling 135.

Figure 6D:
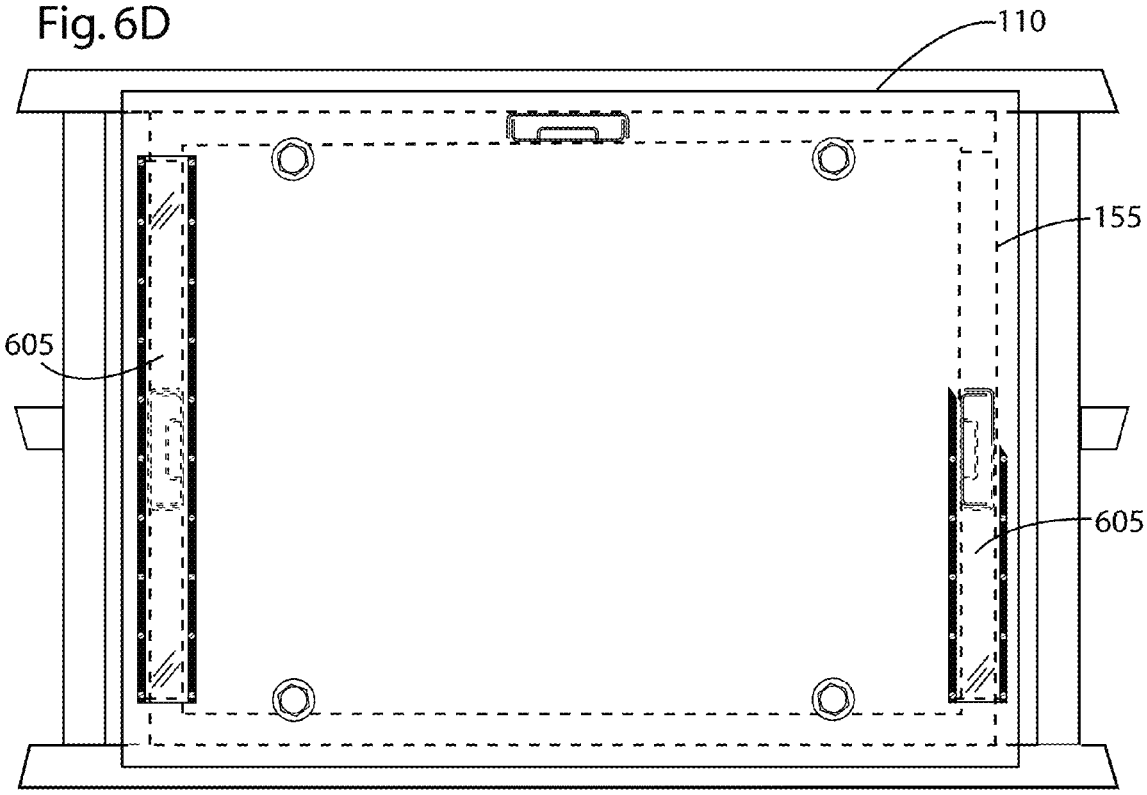
FIGS. 6D and 6E show bottom and detail views of an aspect with an air-blocking barrier that allows heat transfer between a living space and an attic.

FIG. 6D shows a bottom view of panel 110 in an alternative aspect that allows heat transfer between a living space below and an attic above while blocking air flow between the two. Vent openings 155 are covered with an impermeable membrane 605 made of a fire-retardant material such as fire-retardant polyethylene or other plastic, film, tape or even a thin metal or other membrane.

Figure 6E:
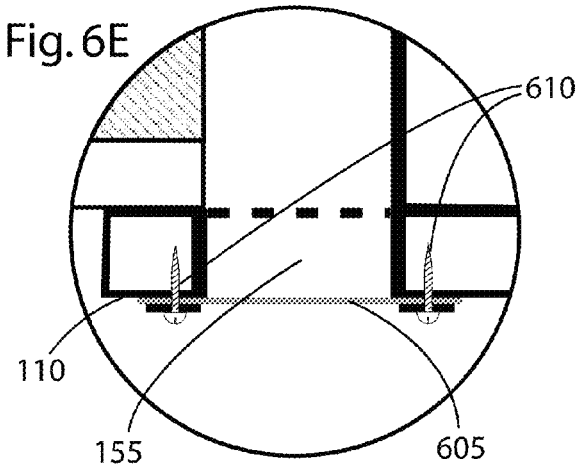

FIG. 6E is a cross-sectional view of a vent opening 155 in panel 110 that is covered by a membrane 605 that is secured to bottom panel 110 by fasteners 610. Heat is conducted through membrane 605 and convective forces in the air on either side of membrane 605 tend to equalize the temperatures between the attic above and the living space below while preventing dust, moths, and the like from passing therethrough. Membrane 605 is optionally transparent, opaque, translucent, and colored, as desired.

DESCRIPTION

Panels—FIGS. 7A through 7I

Figure 7A:
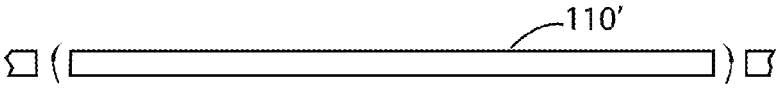
FIGS. 7A-7C show cross-sectional views of several aspects of vented panels for mounting beneath a cabinet.
Figure 7B:
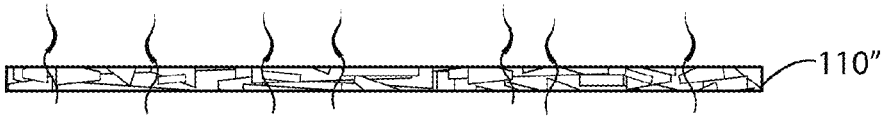
Figure 7C:
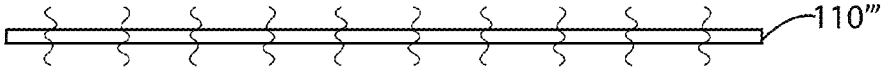
Figure 7D:
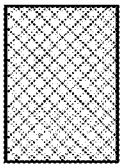
FIGS. 7D-7H show plan views of several aspects of panels for mounting beneath a cabinet.
Figure 7E:
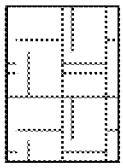
Figure 7F:
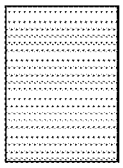
Figure 7G:
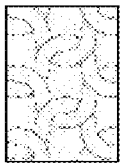
Figure 7H:
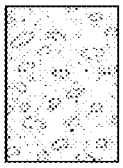

FIGS. 7A through 7C show side views of various types of arrangements that can be used for ceiling panel 110 (FIG. 1A). FIG. 7A shows panel 110' sized to cover only the bottom of cabinet 105, leaving a continuous vent opening 155 all around the outer edge of cabinet 105. FIG. 7B shows a relatively thick panel 110" made of open-cell foam, OSB oriented strand board, MDF medium density fiberboard, particle board, chip board, or other porous or semi porous material. FIG. 7C shows a relatively thin panel 110'" made of non-insulative materials, permitting convective thermal transfer between the air space and living space below. These materials comprise a great variety of wood, metal and plastic products.

FIGS. 7D through 7H show plan views of coverings for vent openings 155 that provide free air flow and have various decorative appearances, such as a screen with diagonal criss-crossing wires, a mosaic with squares of alternating vertical and horizontal parallel lines, simple parallel wires, linked undulating members, and a stippled array with decorative apertures, respectively. These sheet materials include woven screening, woven fabrics, porous and non-porous materials and various plastics, which provide thermal transfer between the air space and living space below.

DESCRIPTION AND OPERATION

Second Alternative Embodiment—FIGS. 8A to 8F

Figure 8A:
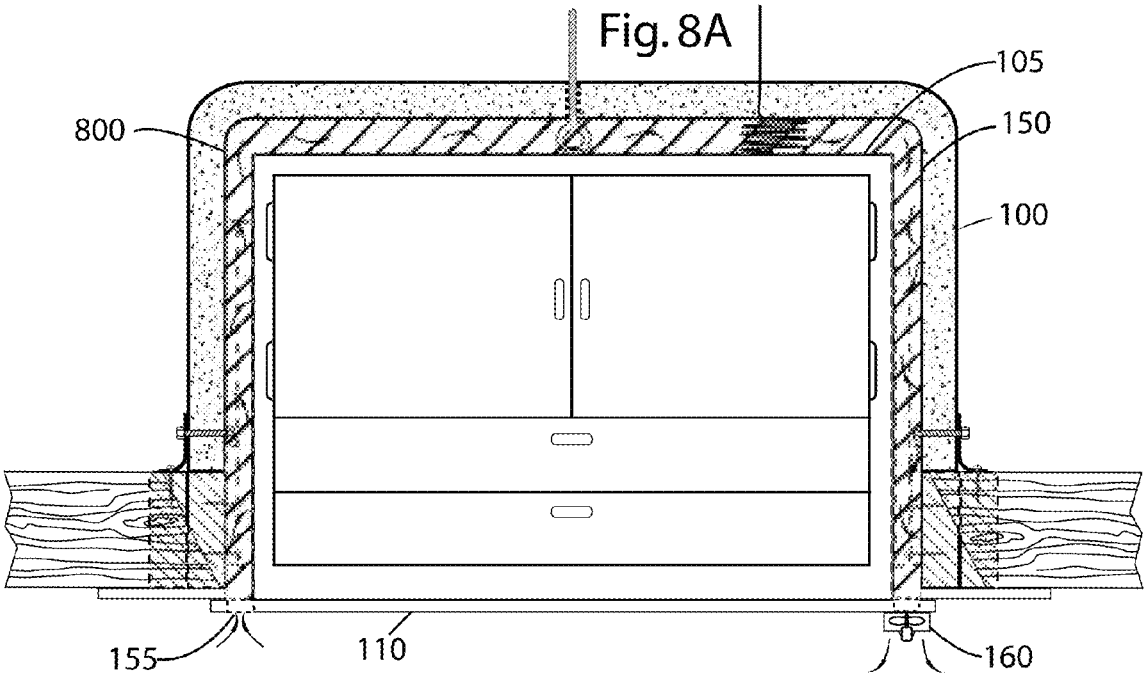
FIGS. 8A through 8F show front and side cut-away views, respectively, of various aspects of baffled and ducted embodiments.
Figure 8B:
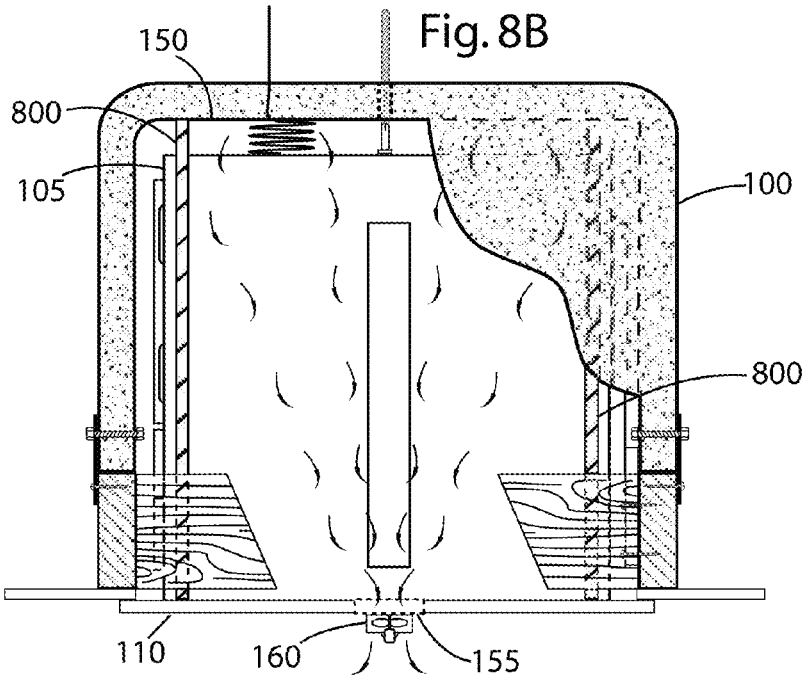

FIGS. 8A (front partly sectional view) and 8B (side partly sectional view) show cut-away front and side views of closet 100 with the addition of ducting baffles 800 in air space 150 between the inner wall of closet 100 and cabinet 105. Baffles 800 are two spaced thin strips (FIG. 8B) (one near the front and one near the rear of cabinet 105) that are secured to the inner walls of closet 100 or outer walls of cabinet 105 by glue or other means. Cabinet 105 abuts baffles 800 when it is fully raised. A fan 160 urges air into one or more vent openings 155 in panel 110 (FIG. 8A) between front and rear baffles 800 and then up the left-hand side, over the top, and down the right-hand side of cabinet 105. Baffle strips 800 extend between the inner side wall of closet 100 and the outer side wall of cabinet 105, upward from panel 110, then across the top of the cabinet, and downward again to panel 110, forming a path for flowing air, urged by fan 160. The baffle strips confine the flowing air to only the sides and top of cabinet 105 although the air flow can be directed to flow over the front, back and top of cabinet as well. Baffling 800 urges air to flow against the outer walls of cabinet 105, as indicated by the curved arrows, and thus is useful when greater assurance of uniformity of the temperature between the air space and the living space below is desired. This is more important in the storage of valuable art material, delicate fabrics, photographs, and the like.

Figure 8C:
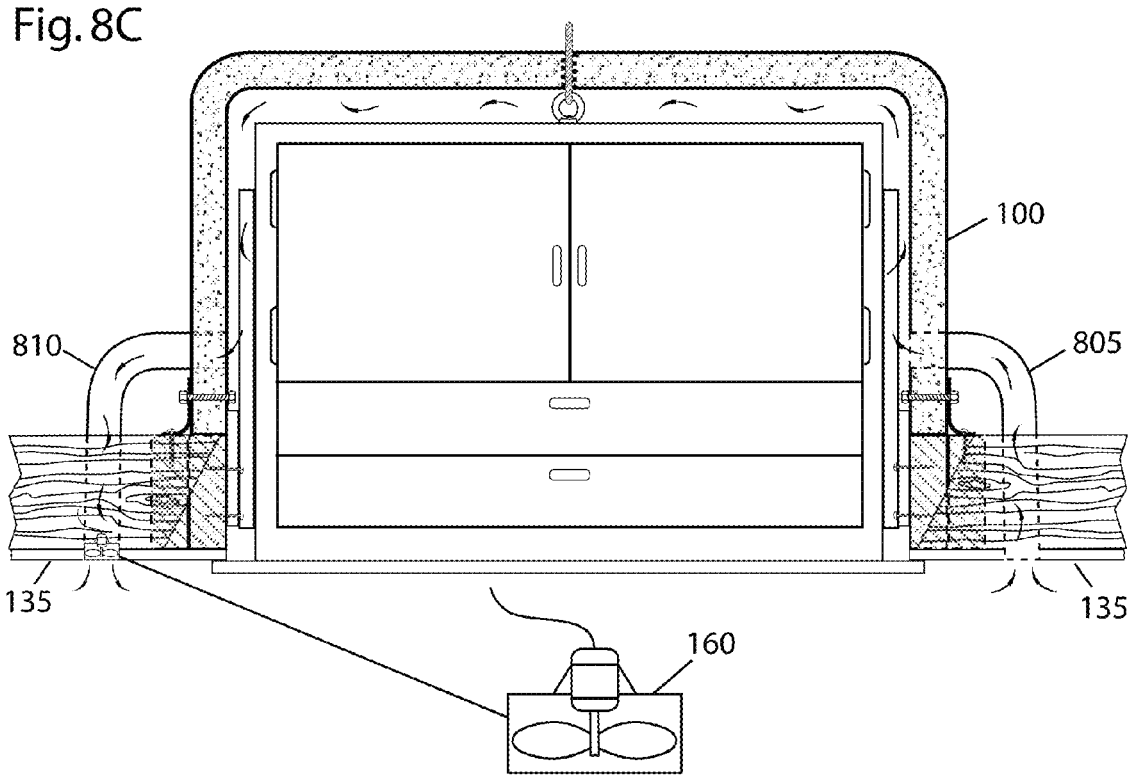
Figure 8D:
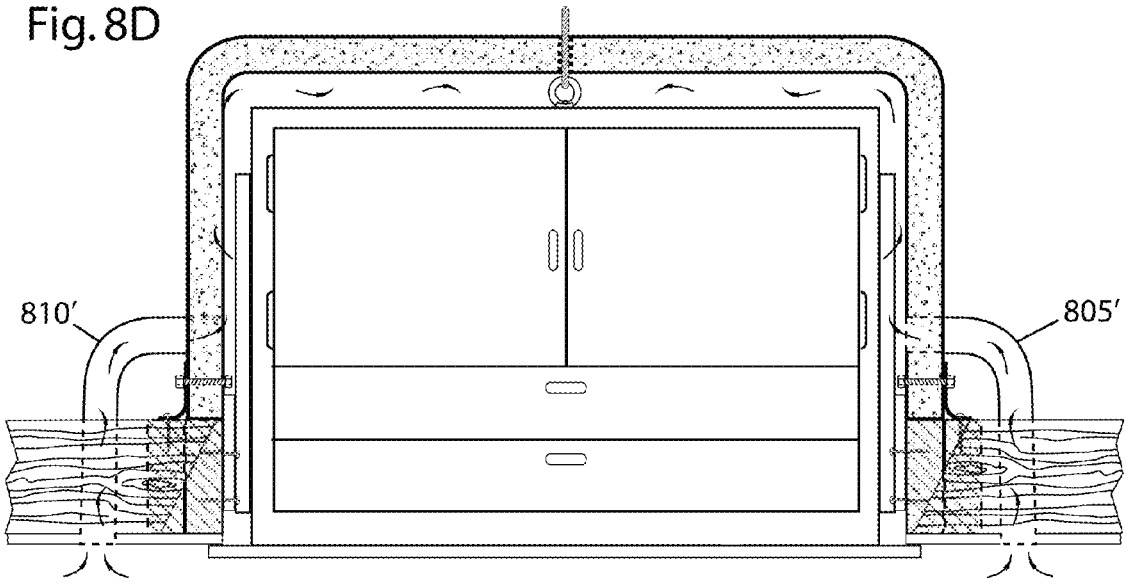

FIGS. 8C and 8D show alternative aspects of the present embodiment. FIG. 8C is a front partly sectional view of a ducted vent with an electric fan to urge airflow through a closet. FIG. 8D is a front partly sectional view of the closet of FIG. 8C without an electric fan.

In FIG. 8C a ducted vent inlet 805 conducts air from a living space beneath ceiling 135 to the region inside closet 100 via a wall of closet 100. A ducted vent outlet 810 conducts air from within closet 100 to the living space beneath ceiling 135 via a wall of closet 100. When it is energized, an electric fan 160 urges the passage of air through closet 100, thereby equalizing the temperature and humidity of air within closet 100 and beneath ceiling 135.

FIG. 8D shows another aspect of the embodiment of FIG. 8C that does not use a fan. In this case, air freely flows from the living space beneath ceiling 135 into and out of closet 100 via a first open vent 805' and a second open vent 810'.

Figure 8E:
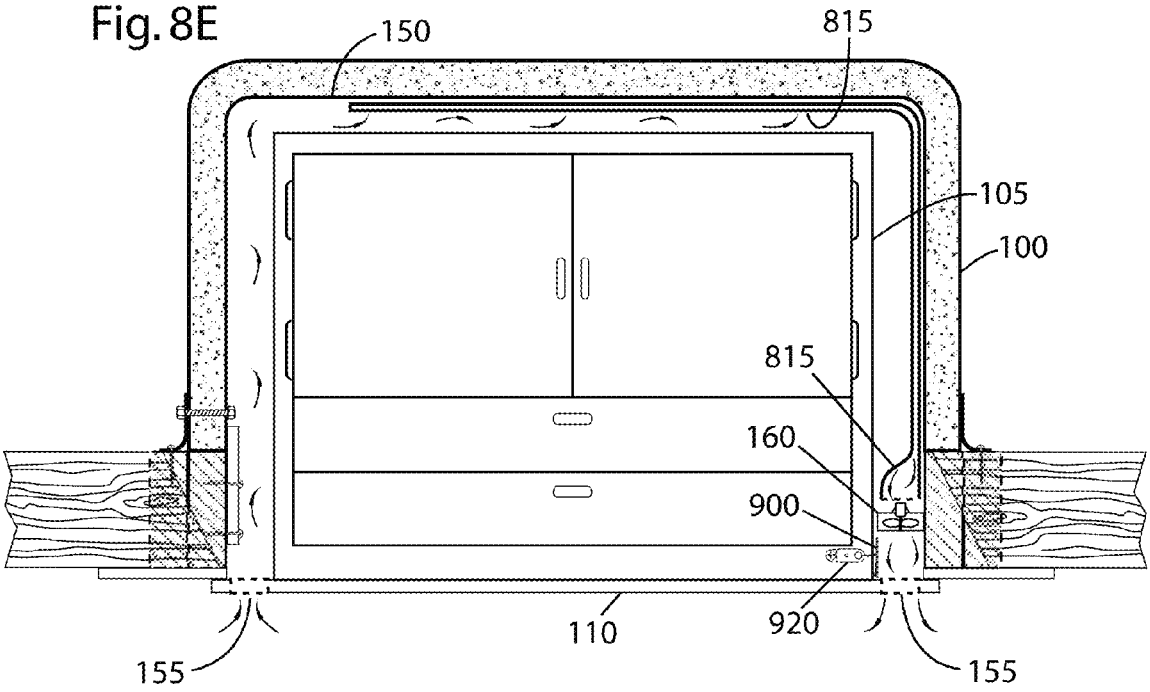

FIG. 8E shows another alternative aspect of the embodiment of FIGS. 8C and 8D. In this aspect a slender duct 815 is secured to an inner wall of closet 100. Duct 815 runs within air space 150 upward and over the top of cabinet 105. Duct 815 includes a plurality of holes 816 at its upper end, as shown in the inset in FIG. 8E. A fan 160 is located at the lower end of duct 815 and is arranged to exhaust air from within duct

815 via a vent opening 155 on the right-hand side of FIG. 8E. Thus, when fan 160 is energized, air from beneath panel 110 enters a vent opening 155 on the left-hand side of FIG. 8E and exits a vent 155 on the right-hand side of FIG. 8E. Many variations of the arrangement of FIG. 8E are possible, including a round, square or oval duct, among others, which can be routed in the front or back of the cabinet, as well as the side. The duct can attach to either the closet or structural members and even the cabinet when used with flexible hose.

Figure 8F:
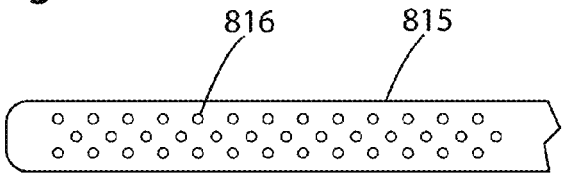

FIG. 8F shows a bottom view of the portion of duct 815 that is located above cabinet 105. Holes 816 pass air into duct 815 when fan 106 is energized. A single hole 816 in duct 815 can be used instead of multiple holes and the holes can be placed in various areas of the duct.

Vents 805 and 810 are 5 cm in diameter and made of plastic or metal tubing, although other sizes and materials can be used. Duct 815 may be rectangular in cross-section and have dimensions that fit within air space 150 so that duct 815 does not interfere with the raising and lowering of cabinet 105. All vents in this embodiment optionally include fusible links 920 and doors 900 for fire protection, as discussed below in connection with FIGS. 9A and 9B. The vents can originate and terminate in the same room or different rooms, or even outside a living space.

DESCRIPTION AND OPERATION

Figure 9A:
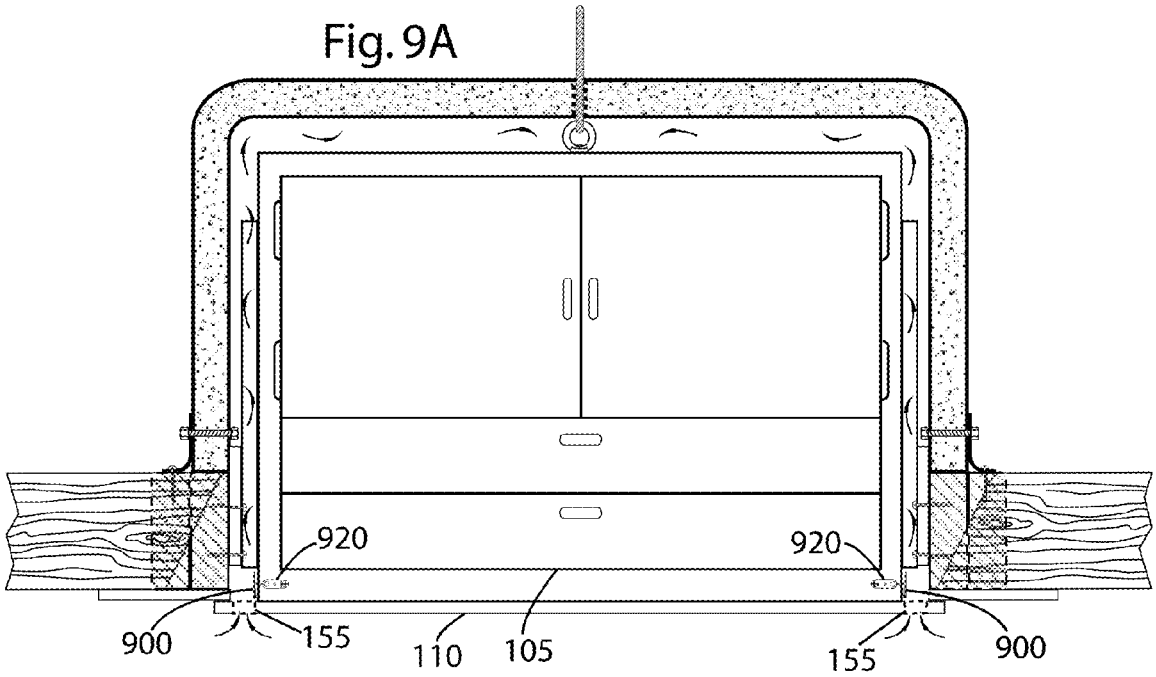
FIGS. 9A and 9B show cut-away and detail views, respectively, of one aspect of a spring-loaded door with a fusible link that releases the door and closes the vent openings in the bottom panel in the event of a fire.
Figure 9B:
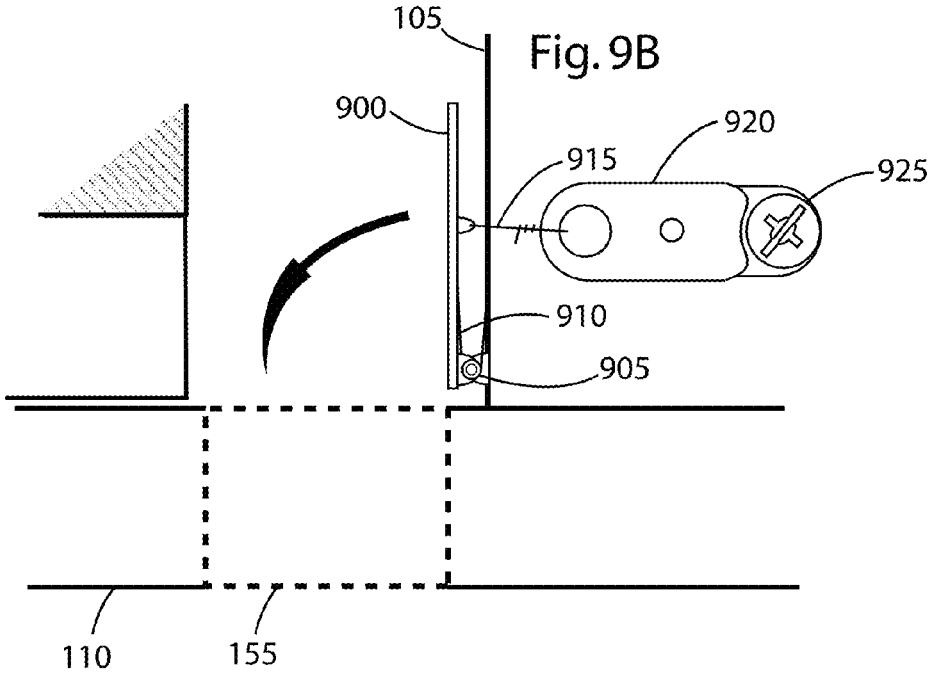

Third Alternative Embodiment—Damper Door—FIGS. 9A and 9B

In the event of a fire, it is important to prevent flames from entering an attic from the living space below, and vice versa. FIGS. 9A and 9B show front and detail views of a fire damper door 900. Door 900 is made of sheet metal or other fireproof or fire retardant material and is mounted on a hinge 905 and is urged to close over vent openings 155 by a spring 910. A restraint 915 is secured to a fusible link 920 which in turn is secured to cabinet 105 by a fastener 925. Restraint 915 and link 920 hold door 900 in a normally open position, allowing free flow of air through vent openings 155.

Sealing Baffle—FIGS. 9C through 9F

Figure 9C:
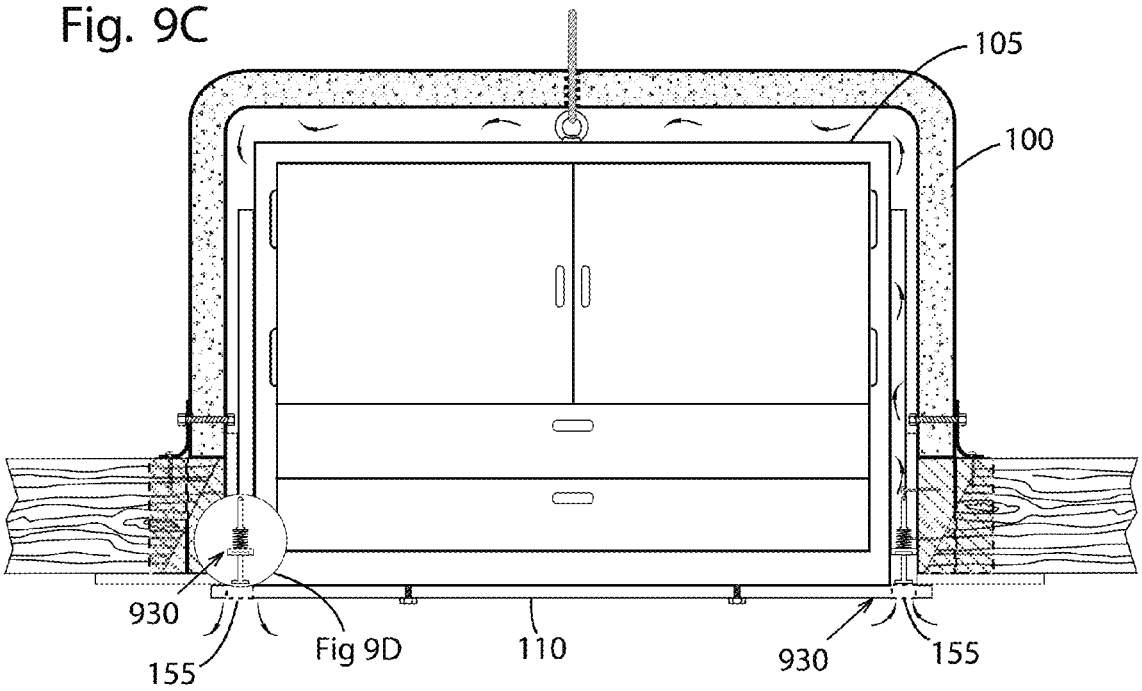
FIGS. 9C through 9F show a spring-loaded barrier with a fusible link that covers vents in the bottom panel in the event of a fire.
Figure 9D:
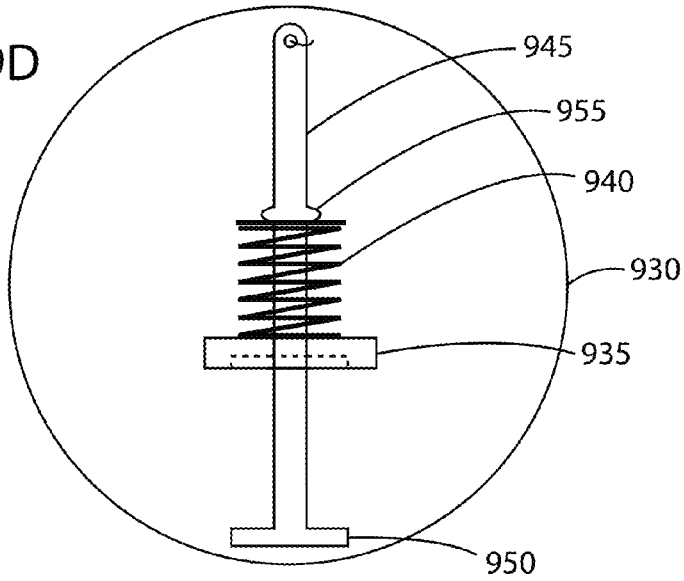
Figure 9E:
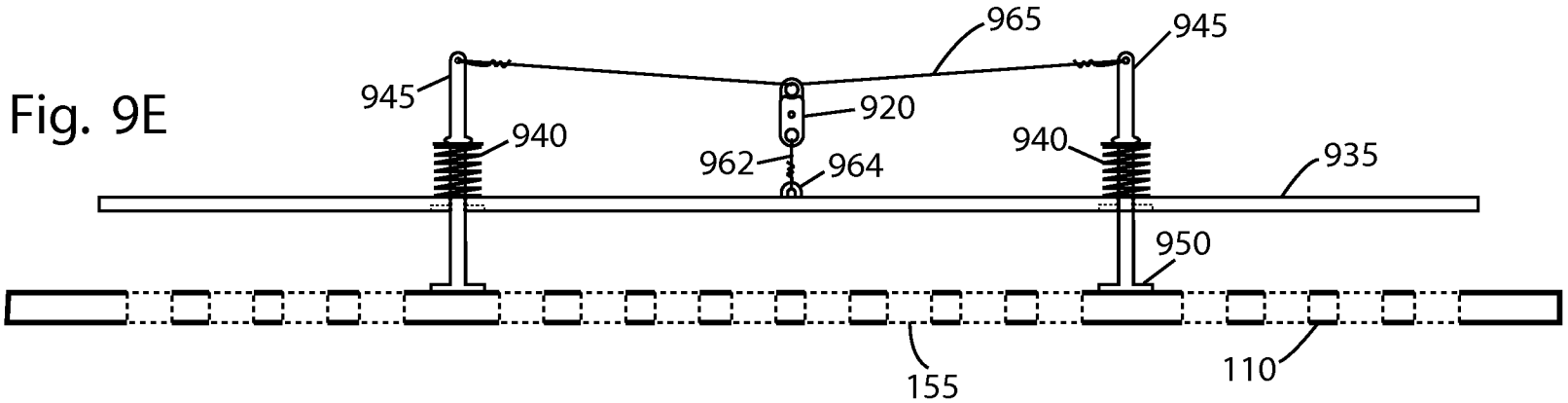
Figure 9F:
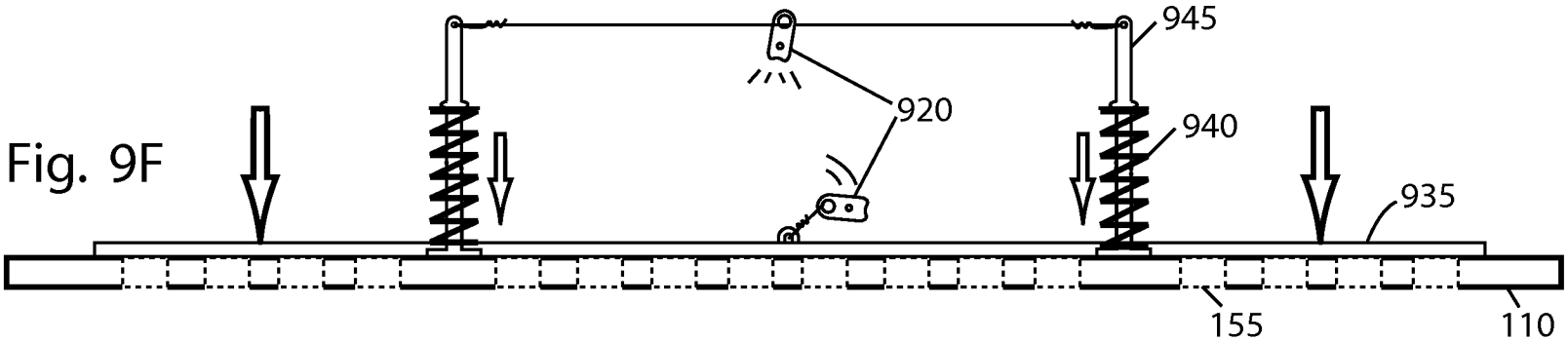

FIGS. 9C through 9F show a sealing baffle that can be used instead of the damper door described above. FIG. 9C is a frontal cut-away view of closet 100, cabinet 105, and panel 110. A baffle assembly 930, shown here in end view, is mounted above each vent opening 155. FIG. 9D shows baffle assembly 930 in greater detail. Baffle assembly 930 comprises a baffle plate 935, and a spring 940 that are securely mounted on one or more brackets 945. A foot 950 of bracket 945 is secured to panel 110 (FIGS. 9E and 9F). Bracket 945 also includes a bulged portion 955 of sufficient size to restrain the upper end of spring 940 and prevent it from sliding further upward on bracket 945.

FIG. 9D shows baffle plate 935 as it is secured above foot 950 in the absence of a fire. When baffle plate 935 is in this upward position, spring 940 is in a compressed condition between baffle plate 935 and bulged portion 955.

FIG. 9E is a side view of baffle plate 935 secured in its uppermost position, allowing air to flow through vent openings 155. Feet 950 of brackets 945 are secured to panel 110. A fusible link 920 is secured by a cord 962 and a bracket 964 to baffle plate 935 at its lower end. The upper end of link 920 is secured to a cord 965 that is strung between two brackets 945. Springs 940 are compressed and their compression force urging plate 935 to move downward is balanced by an upward force via link 920. In the event of a fire, heat from the fire will melt link 920, thereby releasing baffle plate 935 so it can be held in its closed position by spring 940, thus preventing the spread of fire through vent openings 155.

FIG. 9F is a side view of baffle plate 935 in its lowered position, blocking vent opening 155 and permitting no air flow through them. Heat from a fire has passed through vent openings 155 (FIG. 9E) and melted link 920 severing it and releasing baffle 935 to be urged downward by springs 940 as they expand to their less-compressed condition. Fire is thus prevented from spreading from the room beneath panel 110 to the space above panel 110 or in the opposite direction.

In addition to the fusible links shown, resettable fusible links, such as the widely used PHL Links, offered by Globe Technologies Corp., Standish, Mich., as well as others, can be used.

DESCRIPTION AND OPERATION

Figure 10A:
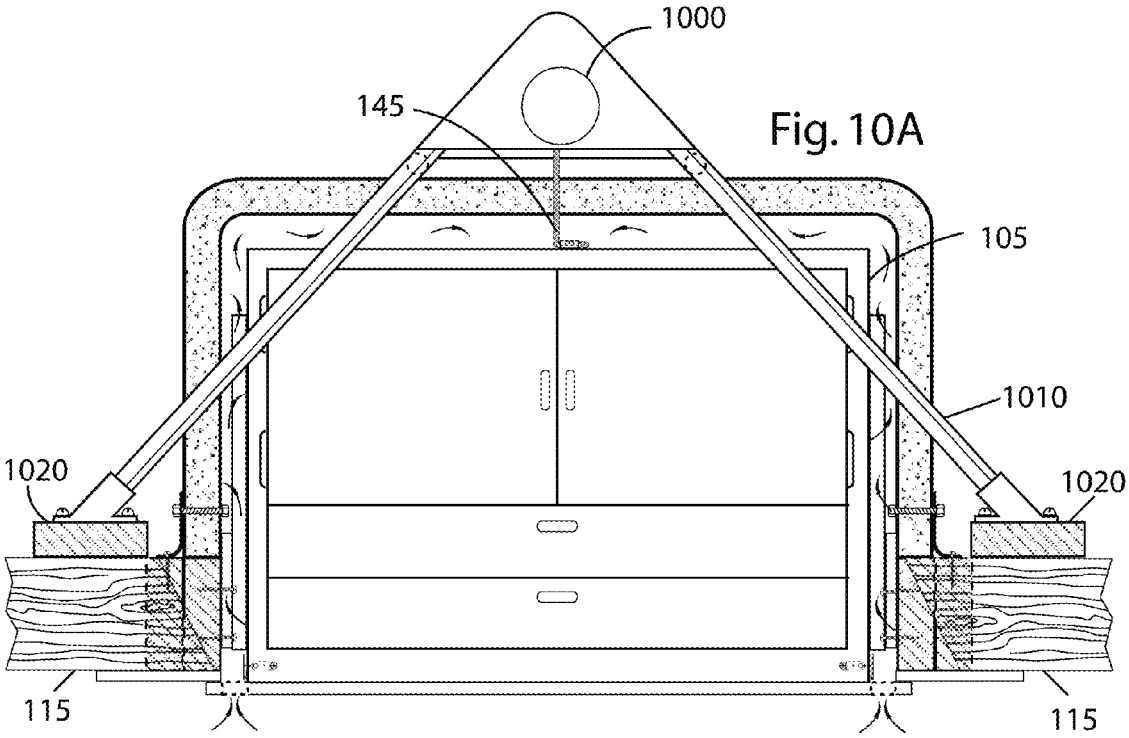
FIGS. 10A and 10B show front and side cut-away views, respectively, of apparatus for raising and lowering a closet or cabinet.
Figure 10B:
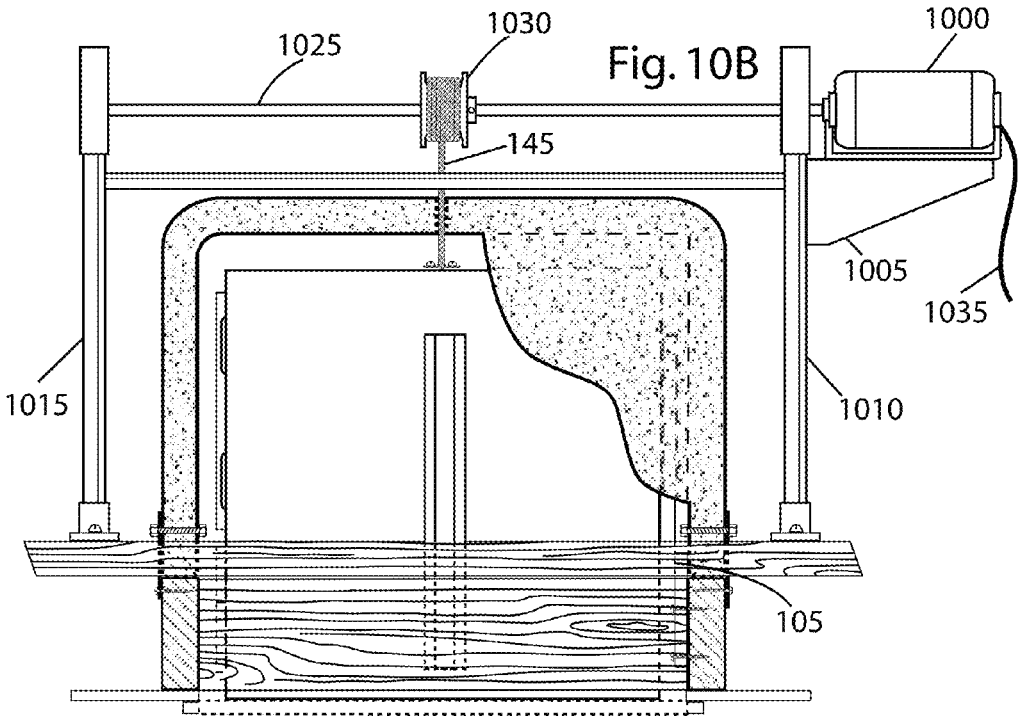
Figure 10C:
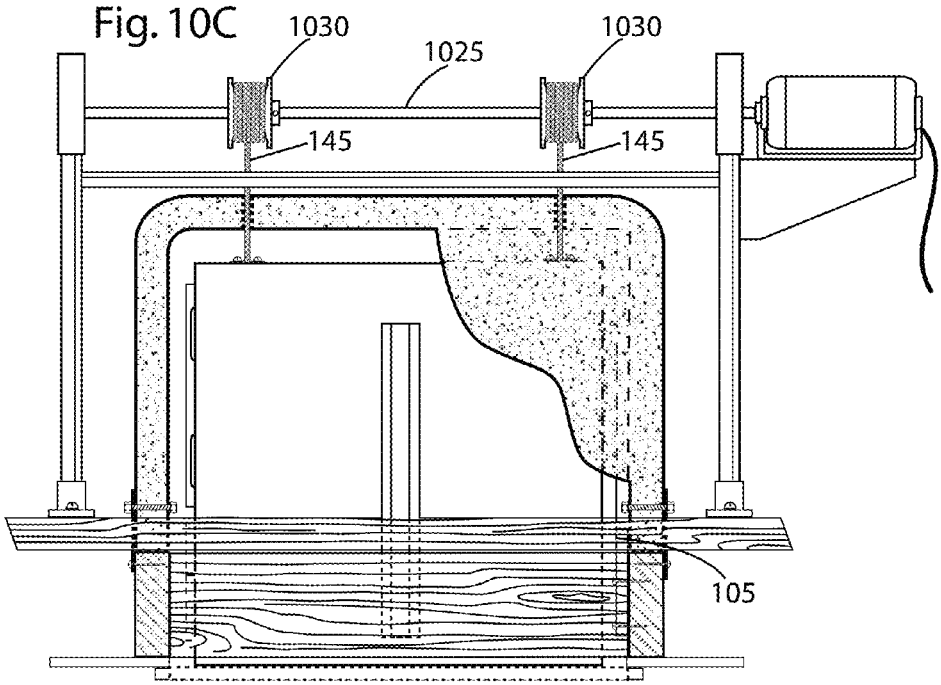
FIG. 10C shows an alternative aspect to the apparatus of FIGS. 10A and 10B with two hoisting cables.

Lift Mechanisms—In the attic—FIGS. 10A to 10C

FIGS. 10A and 10B show front and side views, respectively, of a lift mechanism for raising and lowering cabinet 105. A motor 1000 is supported on a bracket 1005 that is attached to a triangular brace 1010. Brace 1010 and a second triangular brace 1015 are secured to cross-members 1020 that are in turn secured to joists 115 or structural members 120. A shaft 1025, secured to the shaft of motor 1000, rotates in bearings (not shown) within the apices of braces 1010 and 1015. A cable drum 1030 is secured to shaft 1025. Cable drum 1030 is wound with restraining member (rope, cable) 145. The end of member 145 is secured to the top of cabinet 105, as described above. Motor 1000 receives energy from an activatable source (not shown) via a conduit 1035. Activating motor 1000 causes cabinet 105 to be raised or lowered, depending on the direction of rotation of the motor's shaft. Alternatively, motor 1000 can be a spring motor in which spring tension is increased as cabinet 105 is urged downward by an operator, and decreased as the tension in motor 1000 raises cabinet 105 to its upper, stowed position.

FIG. 10C shows a side, cut-away view of an alternative aspect with the addition of a second cable drum 1030 and cable 145 on shaft 1025. In the absence of alternative stabilizers such as slides 200 (FIG. 2A) or casters 220 and skids 215 (FIG. 2C), the added cable and cable drum prevent rotation of cabinet 105 as it is raised and lowered. They also add stability to the entire apparatus in the event that the weight of the contents of cabinet 105 should shift to one side.

Shaft 1025 may incorporate a torsion spring counterbalancing mechanism, similar to that used in overhead garage door lift systems, to reduce motor loading and permit the use of lower capacity, more economical motors.

Figure 10D:
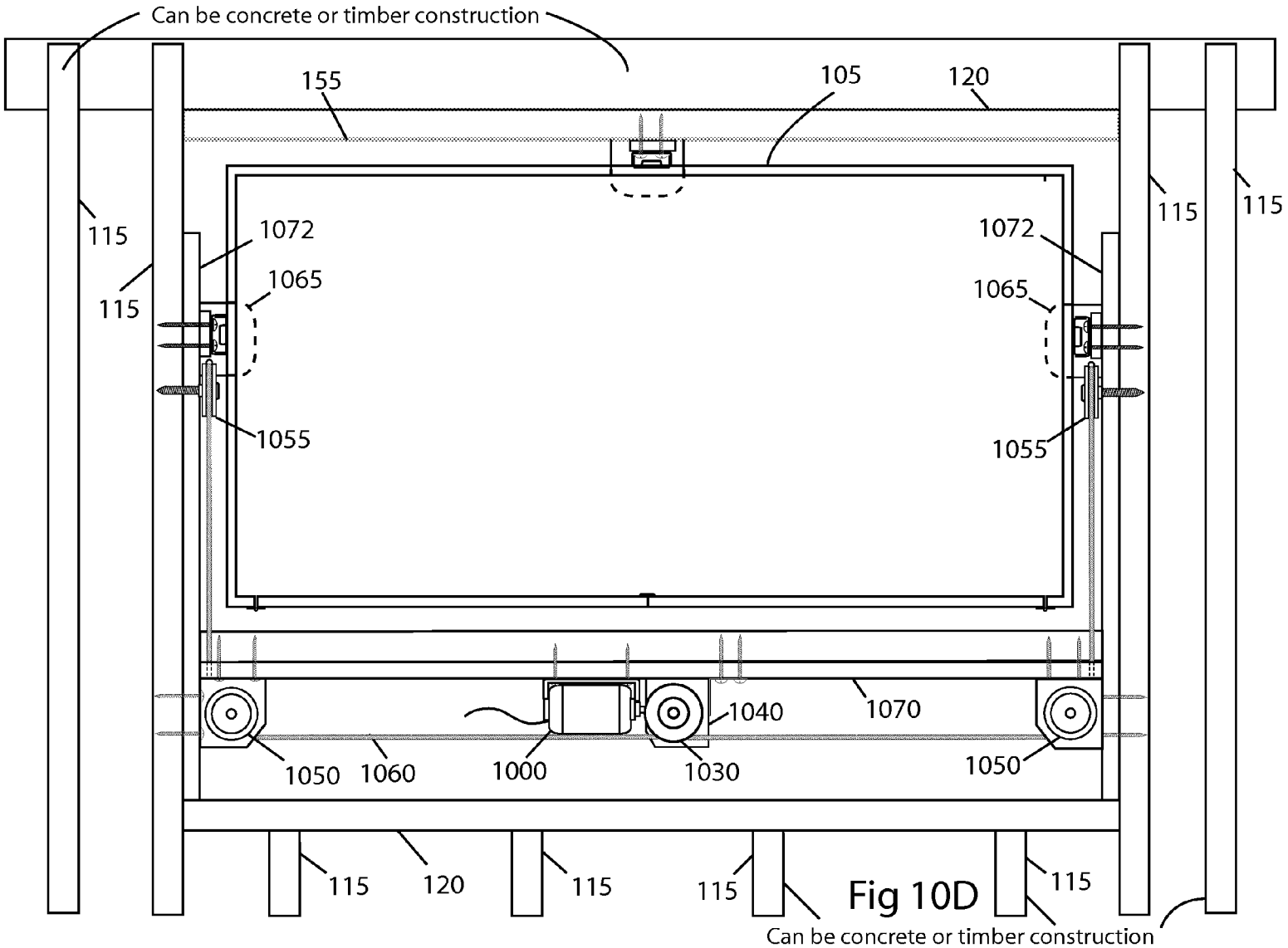
FIGS. 10D and 10E show a top and side cut-away views, respectively, of an alternative apparatus for raising or lowering a closet or cabinet.
Figure 10E:
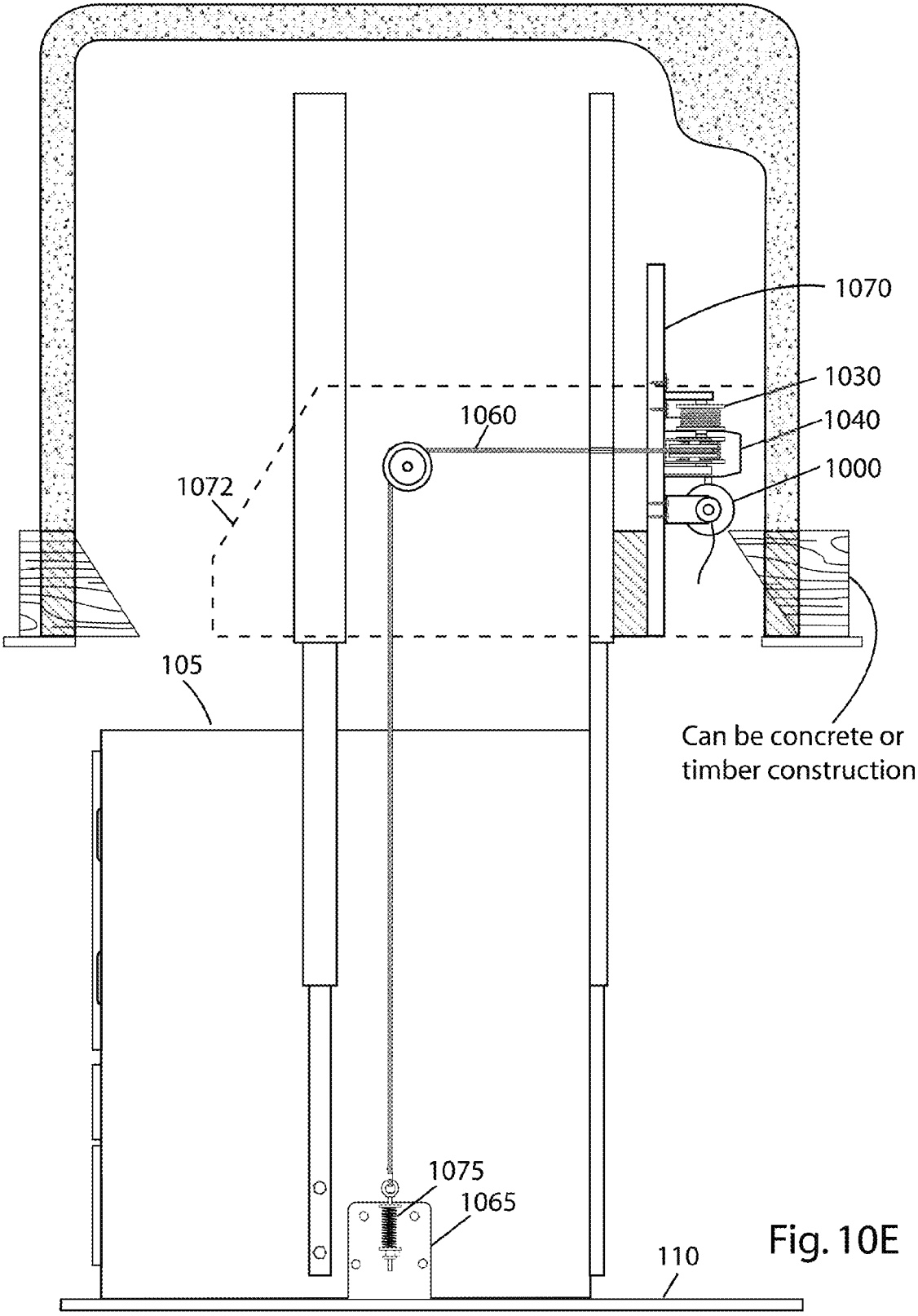

In the Ceiling—FIGS. 10D and 10E

FIGS. 10D and 10E show an alternative embodiment for a lift mechanism. FIG. 10D is a top view of a lift mechanism that is located generally above joists 115 and framing members 120. As well as wood joist and truss construction, this embodiment can be installed in a concrete or timber constructed ceiling. This arrangement is easily accessible from the living space beneath ceiling 135 when cabinet 105, shown in its lowered position in FIG. 10E, has been detached from cables 1060 and sliding members 200. FIG. 10D appears the same whether cabinet 105 is in its raised or lowered position. FIG. 10E shows cabinet 105 in its lowered position.

In this aspect the lift mechanism comprises an electric motor 1000, a speed reducer 1040, a pair of cable drums 1030, a pair of guide pulleys 1050, a pair of lift pulleys 1055, and a cable 1060. Two mirror-image segments of cable 1060 are routed from cable drums 1030, around guide pulleys 1050, over lift pulleys 1055, and down to a pair of lift brackets 1065 that are secured to the bottom of cabinet 105. Motor 1000 and pulleys 1055 are mounted on frontal and side plywood supports 1070 and 1072, respectively.

FIG. 10E shows the attachment of cable segments 1060 to lift brackets 1065 on the bottom of cabinet 105. A spring 1075 can be used to prevent abrupt motion of cabinet 105 and panel 110 when motor 1000 is first energized as well as to allow for imprecise positioning upon elevation to a closed position.

Motor 1000 can include a slip clutch or other over ride mechanism (not shown) to prevent the lifting of excessively heavy loads that may be damaging to joists or structural members. Limit switches can be used to govern the elevation of the cabinet and solenoid activated latches can engage apertures in sliding members when electric motor is deactivated, to prevent accidental lowering of the cabinet.

These same lift mechanisms are usable with the second embodiment, described above, in which closet 100' is raised and lowered.

DESCRIPTION AND OPERATION

Figure 11A:
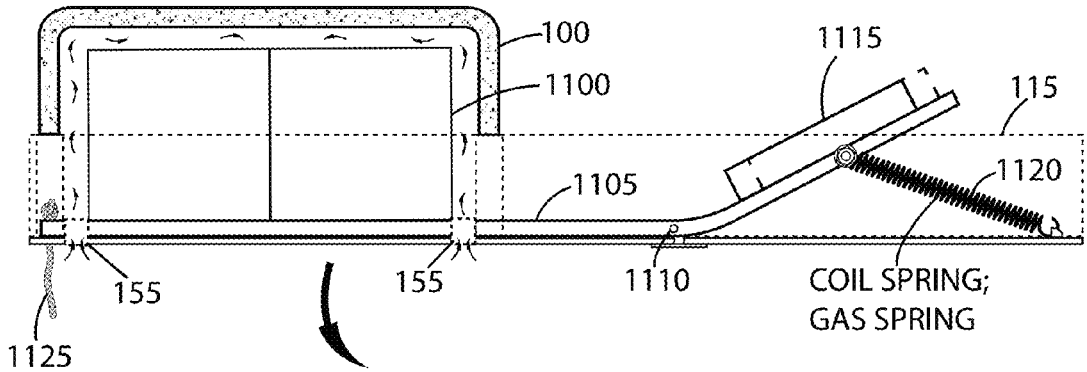
FIGS. 11A and 11B show various aspects of a tilting cantilever system for raising and lowering a cabinet.
Figure 11B:
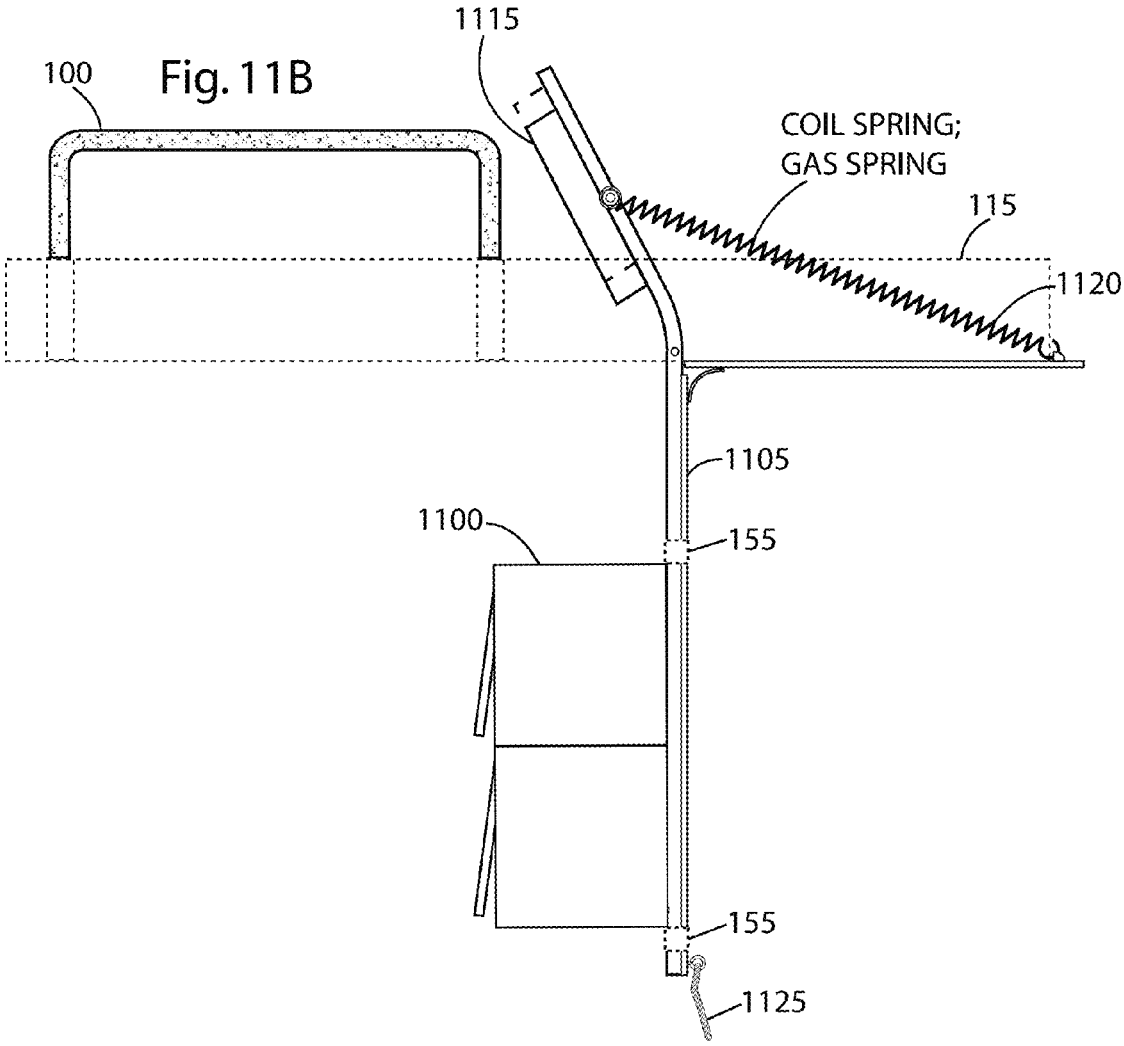

Third Alternative Embodiment—FIGS. 11A and 11B

FIGS. 11A and 11B show side cut-away views of a manually operated mechanism, in this case a cantilever system for raising and lowering a tiltable cabinet 1100 that is arranged to pivot into and out of closet 100 in the attic. FIG. 11A shows cabinet 1100 in its stowed position. Cabinet 1100 is secured at its back side to bent arms 1105. Vent openings 155 are provided between arms 1105 to permit air circulation. Arms 1105 rotate about a pivot 1110 secured between two joists 115 or other structural members. A counterweight 1115 is secured to arm 1105 at the end opposite cabinet 1100 in order to urge arm 1105 to rotate clockwise, thereby urging cabinet 1100 into its stowed position. A spring 1120, such as a coil spring, hydraulic spring, or gas spring, acts to slow the descent of the cabinet when cord 1125 is pulled for access. Manually pushing the lowered bent arm 1105 so that the counterweight 1115 moves past a vertical center line causes the cabinet to elevate into the stowage position with a minimum of effort.

A cord 1125 is secured to the left-hand end of arm 1105. When access to cabinet 1100 is desired, a user (not shown) merely pulls on cord 1125, thereby lowering cabinet 1100. Cabinet 1100 is returned to its stowed position by lifting the same end upward until the portion of arm 1105 to the left of pivot 1110 is once again horizontal.

Although FIGS. 11A and 11B illustrate only one operational mechanism, there are many other possible variations of a counterbalanced and/or spring loaded manually operated device.

DESCRIPTION AND OPERATION

Figure 12A:
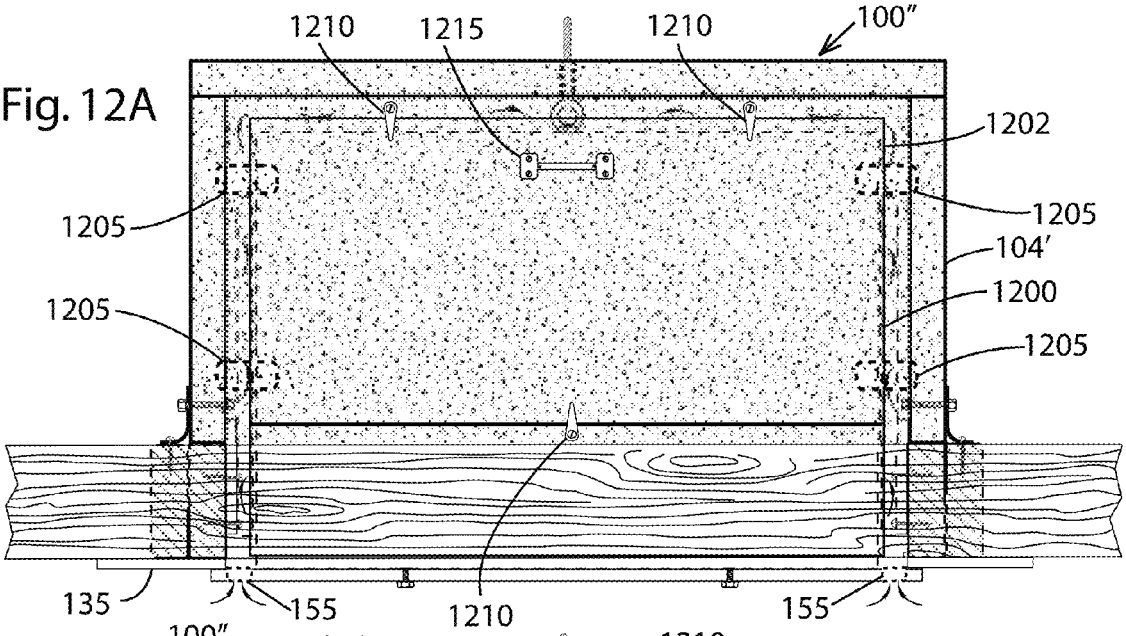
FIGS. 12A and 12B show a closet with a removable panel that permits access from within an attic.
Figure 12B:
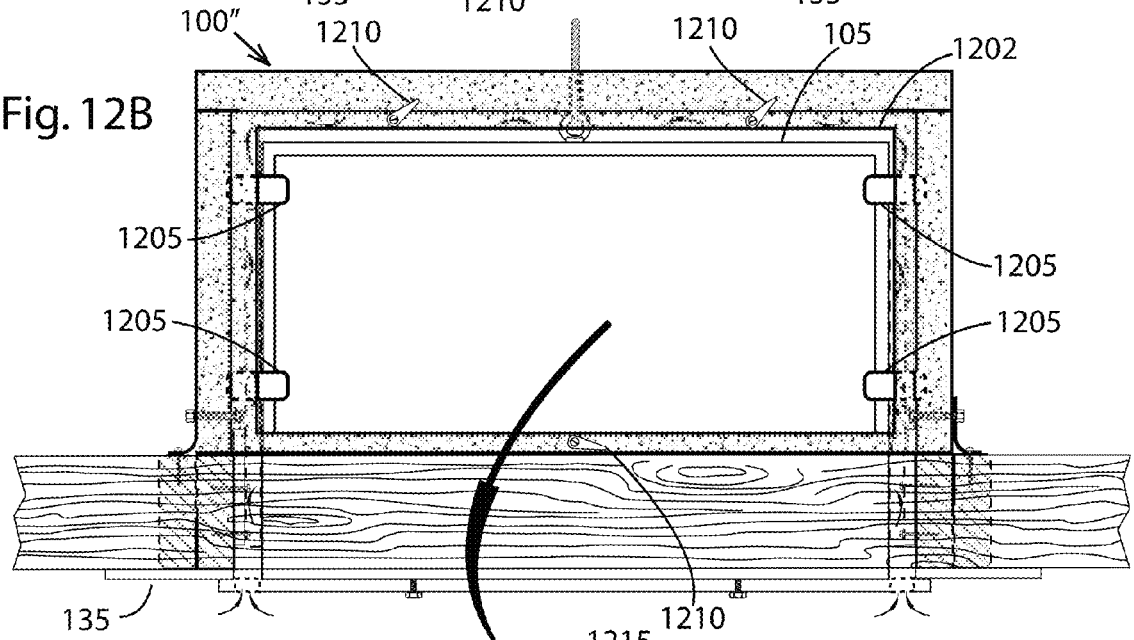
Figure 12C:
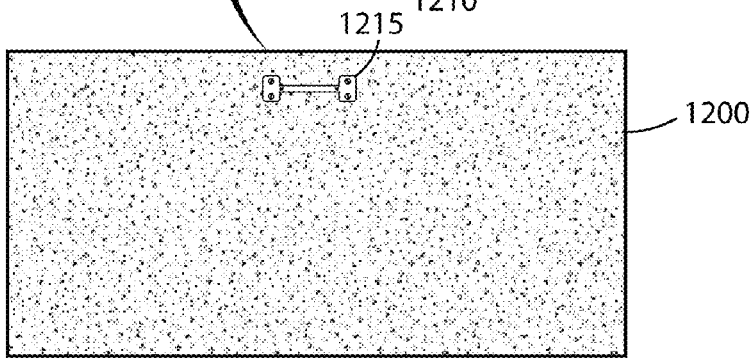
FIG. 12C shows the panel after removal from the closet.

Fourth Alternative Embodiment—FIGS. 12A to 12C

FIGS. 12A through 12C show aspects of another alternative embodiment that is used to transport objects (not shown) between the living space below ceiling 135 and the attic space above ceiling 135. Doors 106 (FIG. 1) can be left in place on cabinet 105 or, in another aspect, are removed for convenience. They have been removed in FIGS. 12A and 12B to show this aspect.

FIG. 12A shows a front view of closet 100". A removable panel 1200 is slidably inserted into an opening 1202 in a wall of closet 100". Opening 1202 is adjacent doors 106 of a cabinet 105, or an opening in place of doors 106 if they are removed. The fit between panel 1200 and opening 1202 is nearly air-tight so that the function of closet 100", i.e. thermal isolation between the air inside closet 100" and the air outside closet 100", is preserved. A handle 1215 is provided on the exterior side of panel 1200 for easy removal of panel 1200 from opening 1202 in closet 100".

Panel 1200 is secured from within closet 100" by a plurality of tabular fingers 1205 that are secured to the inner walls of closet 100" and spaced inwardly from the outside of closet 100" by the thickness of panel 1200. A plurality of rotating clasps 1210 secure panel 1200 to closet 100" so that when clasps 1210 are rotated to their closed positions, as shown in FIG. 12A, panel 1200 is securely held between fingers 1205 and clasps 1210.

FIG. 12B shows a front view of closet 100" with panel 1200 removed. FIG. 12C shows panel 1200 after removal from closet 100". To remove panel 1200 from closet 100", a user rotates clasps 1210 to their open positions shown in FIG. 12B and removes panel 1200 from opening 1202.

To use the feature shown in this embodiment, a user lowers cabinet 105 into the living space beneath ceiling 135, opens a door 106 (if present) on cabinet 105 and inserts an object (not shown) into cabinet 105. The user then closes door 106 (if present) and raises cabinet 105 into the attic space above ceiling 135. The user then enters the attic space above ceiling 135, removes panel 1200 from opening 1202 in closet 100", opens door 106 and retrieves the object for placement elsewhere in the attic. To complete the operation, the user closes door 106, replaces panel 1200 into opening 1202, and rotates clasps 1210 to their closed position. Objects are moved from the attic space to the living space by reversing these steps.

DESCRIPTION AND OPERATION

Figure 13A:
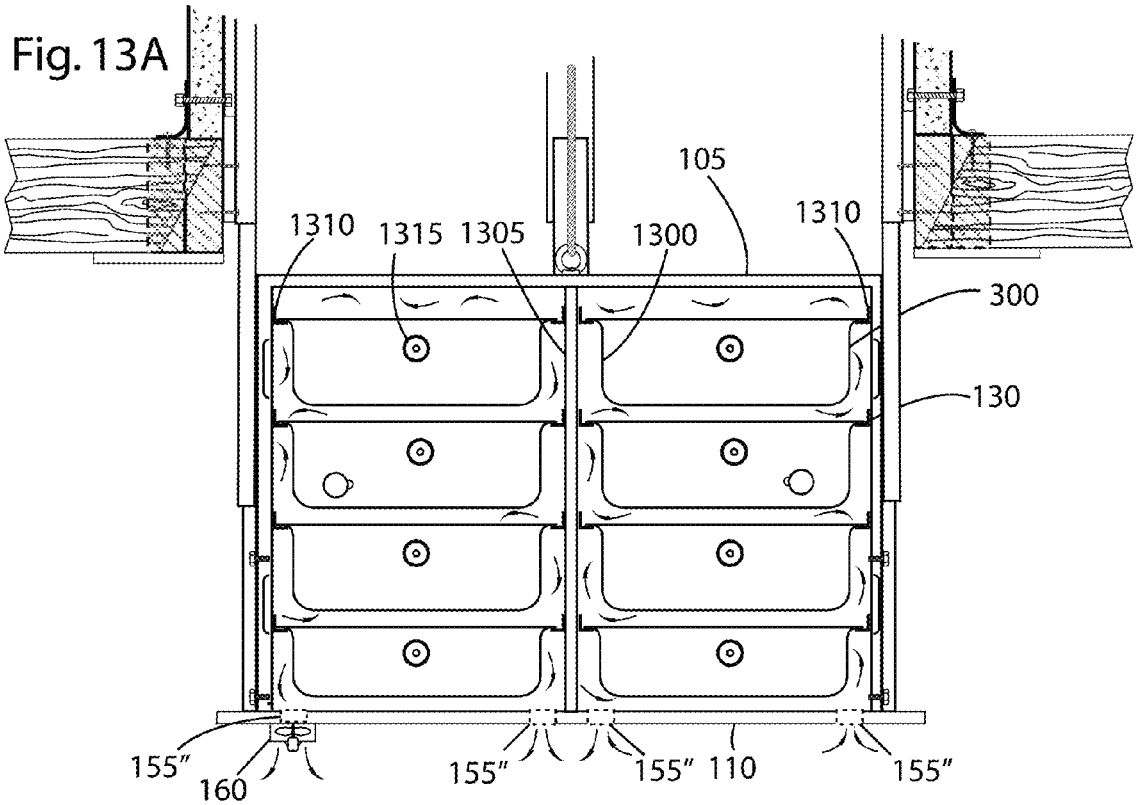
FIGS. 13A and 13B show front, cut-away and bottom views respectively of an aspect of the first embodiment that accommodates a plurality of storage bins.
Figure 13B:
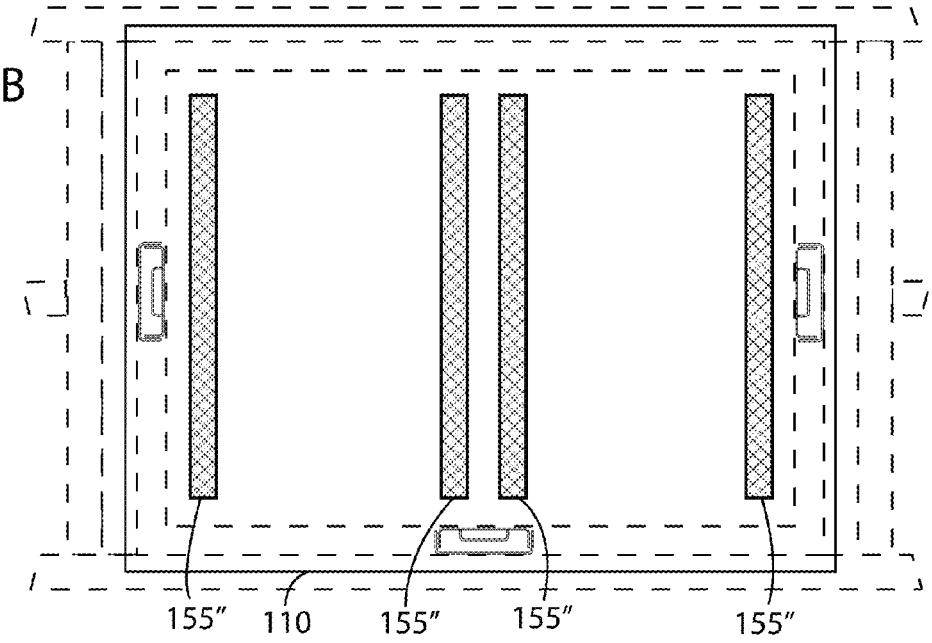

Fifth Alternative Embodiment—FIGS. 13A and 13B

FIGS. 13A and 13B show front cut-away and bottom views, respectively, of an alternative aspect. Doors 106 of cabinet 105, as shown in FIG. 1 and elsewhere, are present, but are removed from this drawing for clarity.

In FIG. 13A, a plurality of storage bins 1300 are contained within cabinet 105. A central partition 1305 divides cabinet 105 into two regions. A plurality of shelf brackets 1310 are arranged on the inner side walls of cabinet 105 and partition 1305 so that bins 1300 are individually slidably removable from cabinet 105 when one or both of doors 106 are open. Drawer pulls 1315 are secured to bins 1300 facilitate removal of bins 1300 from cabinet 105.

In another aspect, partition 1305 is absent and storage bins 1300 are wider so that when they are slidably inserted into cabinet 105 they rest only on brackets 1310 that are affixed to the inner walls of cabinet 105. Alternatively, more than one partition 1305 is used so that bins 1300 of other sizes are stored in cabinet 105. FIG. 13B is a bottom view of cabinet 105 with a single partition 1305, as shown in FIG. 13A. A plurality of vent openings 155" are arranged in panel 110 on either side of partition 1305 and adjacent the inner side walls of cabinet 105 so that air can flow directly through the bottom of the cabinet and circulate among bins 1300. An optional fan 160 (FIG. 13A) urges airflow through cabinet 105.

CONCLUSION, RAMIFICATIONS, AND SCOPE

I have provided an improved attic storage system in which a cabinet is normally stored in an attic. When desired, the cabinet is lowered into the living space below for access. While in the attic, the cabinet is surrounded by a closet which is spaced from the cabinet to provide insulating air space around the cabinet. A vented panel beneath the cabinet or cabinet bottom panel hides the stored cabinet from view. The air space around the cabinet is vented to the living space beneath the attic through vent openings in the panel, thereby reducing temperature swings that would otherwise occur in the cabinet, and protecting the contents of the cabinet from damage due to temperature and humidity extremes. In an alternative embodiment, the cabinet, the air space, the panel, and the closet comprise a movable unit. I.e., the closet, cabinet, panel, and air space are lowered for access to the cabinet, and all are raised for storage. In one aspect of a first embodiment, the cabinet or the cabinet and closet, and the panel are raised and lowered vertically by a motive force, which can be manual, a spring motor, or electrical means, guided by one or more vertical sliding members. In one aspect of a second embodiment, the cabinet and panel are rotatably raised and lowered on a pivoted cantilever mechanism. The cantilevered mechanism includes a weighted portion opposite the end that supports the cabinet. A weight on the weighted portion moves to the same side of the pivot so that the cabinet will stay in its lowered position. When the cabinet is raised part-way toward the attic, the weight moves to the opposite side of the pivot, urging the cabinet into the ceiling. In another aspect, when the cabinet is stowed, air circulation between the air space in the closet and the room below is enhanced by an electric fan. In another aspect, spring-loaded doors are arranged to block the vent openings in the panel in case of a fire. The doors are normally held open by fusible links. When heat from a fire melts the links, they release the doors and air flow between the closet and the room below is blocked, preventing fire from entering the attic. An openable closet permits use of the cabinet for transporting objects between an attic and a living space. Storage bins can be carried within the cabinet.

While the above description contains many specificities, these should not be construed as limitations on the scope, but as exemplifications of some present embodiments. Many other ramifications and variations are possible within the teachings. Additional features can be added, such as decorative graphics, a light fixture, or a television facing into the room below the cabinet. Additional cables can be used to raise and lower a cabinet. An electrical key lock can be used to control the motor that hoists and lowers the cabinet from the attic into the living space. A simple lock mechanism can keep the cantilever embodiment in its stowed position. Such locks are useful when condominium owners wish to securely store their valuables when renting the living space to others, for example. An over-current sensor or a torque-limiting clutch can be added to the hoist motor. This will protect against accidental injury when the cabinet is moving up or down, and also prevent damage to the ceiling structure when the cabinet is overloaded. Limit switches can be employed to prevent excessive up and down movement as can electrical door contact switches, to prevent raising of a cabinet when doors are open. A jacking crank for manual lowering in event of motor or power failure can be integrated into the drive mechanism. Also, the materials and sizes can be changed, as can the shapes of the components. The vertical slides or casters and skids that guide the cabinet into the closet can be eliminated, if desired. In that case, the user would manually guide the cabinet as it is raised. A remote smoke detector, such as that sold by Flinn Scientific, Inc., Batavia, Ill., can be placed in a closet and/or attic space with the alarm affixed to a bottom panel, ceiling or other location in the living space, so that in the event of smoke or fire above, the alarm is audible below.

Thus the scope should be determined by the appended claims and their legal equivalents, rather than the examples and particulars given.

The invention claimed is:

1. A storage system comprising:

a closet or enclosure having a plurality of enclosing walls with inner sides, a top, and a downward-facing opening, a cabinet, said cabinet being movable into and out of said closet or enclosure, said cabinet having a bottom, a top, and a plurality of side walls connecting said bottom and said top of said cabinet, said cabinet and said closet or enclosure being dimensioned so that when said cabinet is positioned in said closet or enclosure, there will be (a) a first air space around and surrounding all of said side walls and said top of said cabinet, between the outsides of all of said side walls and said top and said inner sides of said walls of said closet or enclosure, and (b) a second air space below said bottom of said cabinet, said first air space around the outsides of all of said side walls and said top of said cabinet communicating with said second air space below said bottom of said cabinet so that air can flow there between, means for raising said cabinet upward into said closet or enclosure and lowering said cabinet downward out of said closet or enclosure, and a panel attached to said bottom of said cabinet, said panel arranged to seal said downward-facing opening when said cabinet is raised into said closet or enclosure, said panel including at least a first vent opening permitting communication between said first and said second air spaces, whereby when said cabinet is raised into said closet or enclosure, air can circulate around the entire outside of said side walls and said top of said cabinet and said first and second air spaces will be in communication so that air can flow between said first and second air spaces, whereby the temperatures of said first and said air spaces will tend to equalize when the air in said first air space is colder than the air in said second air space.

2. The storage system of claim 1 wherein said means for raising and lowering said cabinet comprises a motor, a speed reducer, a plurality of pulleys, a plurality of cables, and at least one bracket attached to said cabinet.

3. The storage system of claim 1, further including an attic and a living space adjacent and beneath said attic and a ceiling separating said attic and said living space, said closet or enclosure being mounted in said attic and said downward-facing opening communicating with said living space.

4. The storage system of claim 1, further including a fan positioned and arranged so that when energized, said fan urges air to flow from said second air space to said first air space, thereby causing the temperature of air within said first air space to equalize with the temperature of said second air space below.

5. The storage system of claim 1, further including:

a vent opening between said first and second air spaces, at least one flapper valve over said vent opening, springably arranged to close, at least one fusible link holding said flapper valve in an open position so that air can freely pass between said first and second air spaces, whereby in the event of a fire, said fusible link will release said flapper valve, thereby allowing said flapper valve to close, and prevent said fire from passing between said first and second air spaces.

6. The storage system of claim 1, further including a decorative material selected from the group consisting of woven screening, woven fabric, porous material, non-porous material, and plastic located between said first and second air spaces.

7. The storage system of claim 1, further including:

a first baffle secured to an inner side of one of said enclosing walls of said closet or enclosure, said one of said enclosing walls of said closet or enclosure being located adjacent one wall of said cabinet, a second baffle secured to an inner side of another of said enclosing walls of said closet or enclosure, said other of said enclosing walls of said closet or enclosure being located adjacent a wall of said cabinet opposite said one wall of said cabinet, said first and said second baffles being positioned in said air space between said inner sides of said one and said other enclosing walls of said closet or enclosure and said cabinet when said cabinet is fully raised, said first and said second baffles thereby defining a ducted air space, a panel located in said ceiling, a first vent opening in said panel at a point between said first and second baffles on a first vertical side of said cabinet, a second vent opening in said panel at a point between said first and second baffles on a second vertical side of said cabinet, a fan arranged to urge air from said second air space to pass through said first and second vent openings and said ducted air space, whereby air from said second air space is circulated over said cabinet in a predetermined path.

8. The storage system of claim 1 wherein said panel is attached to said bottom of said cabinet by means selected from the group consisting of removable and non-removable means.

9. The storage system of claim 1, further including a fan located to force air through said first air space, thereby increasing the rate of circulation to said air space between said cabinet and said inner sides of said walls of said closet or enclosure.

10. The storage system of claim 1, further including:

a duct secured within said closet or enclosure and extending upward from a bottom area of said closet or enclosure and reaching to a top, inner surface of said closet or enclosure, said duct having a fan and having at least one opening at said top, inner surface of said closet or enclosure, said duct opening being positioned so that when activated, said fan exhausts said air from said top, inner area of said closet or enclosure via said duct, thereby circulating air from said second air space through said first air space in order to equalize the temperature of air within said first air space with said second air space below.

11. The storage system of claim 1, further including:

a support member selected from the group consisting of a joist, a header, a bottom chord, a framing member, a timber structured ceiling, and a concrete ceiling, at least one bracket comprising at least first and second parts, said first part being secured to said support member and said second part being secured to said cabinet, whereby said bracket guides the path of said cabinet when said cabinet is raised and lowered.

12. The storage system of claim 1 wherein said closet or enclosure is made from a thermally insulating material selected from the group consisting of calcium silicate, fireproof expanded polyethylene foam sheet with aluminum film siding, magnesium oxide cementitious foam, and polystyrene.

13. The storage system of claim 1 wherein said means for raising said cabinet upward into said closet or enclosure and lowering said cabinet downward out of said closet or enclosure uses power selected from the class consisting of manual power and electrical power.

14. A storage system comprising:

a closet or enclosure having a plurality of enclosing walls with inner sides, a top and a downward-facing opening, a cabinet having a plurality of walls, a bottom, and a top, said cabinet being movable into and out of said closet or enclosure, said cabinet and said closet or enclosure being dimensioned so that when said cabinet is positioned in said closet or enclosure, there will be a first air space around said top and said walls of said cabinet and said inner sides of said walls of said closet or enclosure, a second air space below said bottom of said closet or enclosure, a fan positioned and arranged so that when energized, said fan urges air from said second air space to flow to said first air space, means for raising said cabinet upward into said closet or enclosure and lowering said cabinet downward out of said closet or enclosure, whereby when said cabinet is raised into said closet or enclosure, said fan can be energized to cause air to flow from said second air space through said first air space so that the temperatures of said first and said second air spaces will tend to equalize.

15. The storage system of claim 14 wherein said fan is mounted in said closet or enclosure.

16. The storage system of claim 14, further including a duct connected to said first air space and wherein said fan is mounted so as to supply air to said duct.

17. The storage system of claim 14 wherein said means for raising and lowering said cabinet comprises a motor, a speed reducer, a plurality of pulleys, a plurality of cables, and at least one bracket attached to said cabinet.

18. The storage system of claim 14, further including: an attic and a living space adjacent and beneath said attic, a ceiling separating said attic and said living space, said closet or enclosure being mounted in said attic and said downward-facing opening communicating with said living space.

19. The storage system of claim 14, further including:

a vent opening between said first and second air spaces, at least one flapper valve over said vent opening, springably arranged to close, at least one fusible link holding said flapper valve in an open position so that air can freely pass between said first and second air spaces, whereby in the event of a fire, said fusible link will release said flapper valve, thereby allowing said flapper valve to close, and prevent said fire from passing between said first and second air spaces.

20. A storage system comprising:

a closet or enclosure having a plurality of enclosing walls with inner sides, a top and a downward-facing opening, a cabinet having a plurality of side walls, a bottom, and a top, said cabinet being movable into and out of said closet or enclosure, said cabinet and said closet or enclosure being dimensioned so that when said cabinet is positioned in said closet or enclosure, there will be (a) a first air space around and surrounding all of said side walls and said top of said cabinet, between the outsides of all of said side walls and said top and said inner sides of said walls of said closet or enclosure, and (b) a second air space below said bottom of said cabinet, a panel attached and positioned at the bottom of said cabinet arranged to seal said first air space from said second air space at their bottom junction when said cabinet is elevated into said closet or enclosure, at least one duct attached to said closet or enclosure, said duct being arranged and positioned to allow air communication between said first air space and said second air space below said bottom of said cabinet so that air can flow therebetween, and means for raising said cabinet upward into said closet or enclosure and lowering said cabinet downward out of said closet or enclosure, whereby when said cabinet is raised into said closet or enclosure, said first and second air spaces will be in communication so that air can flow between said first and second aid spaces, whereby the temperatures of said first and said air spaces will tend to equalize when the air in said first air space is colder than the air in the second air space.

21. The storage system of claim 20, further including at least one fan positioned and arranged so that when activated, said fan increases circulation of air from said second air space through said first air space in order to equalize the temperature of air within said first air space with the temperature of said second air space below.

* * * * *

UNITED STATES PATENT AND TRADEMARK OFFICE

CERTIFICATE OF CORRECTION

PATENT NO. : 8,820,003 B2
APPLICATION NO. : 13/968229
DATED : September 2, 2014
INVENTOR(S) : Jack Z. DeLorean It is certified that error appears in the above-identified patent and that said Letters Patent is hereby corrected as shown below:

Claims

Column 16, line 17, Claim 1, line 13, after "inner sides" insert --and said top--.

Column 16, line 37, Claim 1, line 33, after "and said" insert --second--.

Column 18, line 17, Claim 14, line 11, after "said walls" insert --and said top--.

Signed and Sealed this
Twenty-second Day of March, 2016

Michelle K. Lee

Michelle K. Lee
*Director of the United States Patent and Trademark Office*